US010733841B2

(12) United States Patent
Decasa, Jr. et al.

(10) Patent No.: US 10,733,841 B2
(45) Date of Patent: Aug. 4, 2020

(54) GAMING SYSTEM AND METHOD FOR PROVIDING A BONUS BASED ON NUMBER OF GAMING MACHINES BEING ACTIVELY PLAYED

(71) Applicant: IGT, Las Vegas, NV (US)

(72) Inventors: Rogelio S. Decasa, Jr., Reno, NV (US); Kelsy J. Grace, Reno, NV (US); Anthony J. Baerlocher, Henderson, NV (US)

(73) Assignee: IGT, Las Vegas, NV (US)

( * ) Notice: Subject to any disclaimer, the term of this patent is extended or adjusted under 35 U.S.C. 154(b) by 503 days.

(21) Appl. No.: 15/046,018

(22) Filed: Feb. 17, 2016

(65) Prior Publication Data

US 2016/0163156 A1 Jun. 9, 2016

Related U.S. Application Data

(60) Continuation of application No. 13/324,661, filed on Dec. 13, 2011, now Pat. No. 9,269,213, which is a (Continued)

(51) Int. Cl.
*G07F 17/32* (2006.01)
*G07F 17/34* (2006.01)

(52) U.S. Cl.
CPC ..... *G07F 17/3258* (2013.01); *G07F 17/32* (2013.01); *G07F 17/323* (2013.01); (Continued)

(58) Field of Classification Search
CPC ..... A63F 13/00; G07F 17/32 (Continued)

(56) References Cited

U.S. PATENT DOCUMENTS 5,046,736 A 9/1991 Bridgeman et al.
5,283,734 A 2/1994 Von Kohorn
(Continued)

FOREIGN PATENT DOCUMENTS

WO WO 2000 032286 A1 6/2000
WO WO 2001 015055 A1 3/2001
(Continued)

OTHER PUBLICATIONS

Alfastreet D8 description, Alfa street Gaming Instruments, available on or before Nov. 13, 2006.
(Continued)

*Primary Examiner* — Michael C Grant
(74) *Attorney, Agent, or Firm* — Neal, Gerber & Eisenberg LLP

(57) ABSTRACT

A gaming system includes a controller linked to a plurality of gaming devices. The central server tracks: (i) a quantity of gaming devices being actively played by players, or (ii) a quantity of players actively playing at the gaming devices. The controller determines the players' eligibility for different awards based on the tracked quantity. When the controller tracks a first quantity, the controller provides the active players with an opportunity to win a first award. When the central server tracks a second quantity, the central server provides the active players with an opportunity to win a second award. As the tracked quantity changes, the controller determines or modifies the number of awards available to the players actively playing at the gaming devices.

20 Claims, 14 Drawing Sheets

Related U.S. Application Data division of application No. 12/138,203, filed on Jun. 12, 2008, now Pat. No. 8,092,297.

(60) Provisional application No. 60/986,092, filed on Nov. 7, 2007.

(52) U.S. Cl.
CPC ..... *G07F 17/3232* (2013.01); *G07F 17/3234* (2013.01); *G07F 17/3244* (2013.01); *G07F 17/3269* (2013.01); *G07F 17/34* (2013.01)

(58) Field of Classification Search
USPC ..... 463/20, 26, 27, 206
See application file for complete search history.

(56) References Cited

U.S. PATENT DOCUMENTS 5,324,041 A 6/1994 Boylan et al.
5,544,892 A 8/1996 Breeding
5,655,961 A 8/1997 Acres et al.
5,697,844 A 12/1997 Von Kohorn
5,702,304 A 12/1997 Acres et al.
5,713,795 A 2/1998 Von Kohorn
5,741,183 A 4/1998 Acres et al.
5,743,798 A 4/1998 Adams et al.
5,752,882 A 5/1998 Acres et al.
5,820,459 A 10/1998 Acres et al.
5,836,817 A 11/1998 Acres et al.
5,876,284 A 3/1999 Acres et al.
5,916,024 A 6/1999 Von Kohorn
6,008,784 A 12/1999 Acres et al.
6,019,374 A 2/2000 Breeding
6,110,043 A 8/2000 Olsen
6,146,273 A 11/2000 Olsen
6,162,122 A 12/2000 Acres et al.
6,179,710 B1 1/2001 Sawyer et al.
6,206,782 B1 3/2001 Walker et al.
6,210,275 B1 4/2001 Olsen
6,217,448 B1 4/2001 Olsen
6,224,485 B1 5/2001 Dickinson et al.
6,231,445 B1 5/2001 Acres
6,244,958 B1 6/2001 Acres
6,254,483 B1 7/2001 Acres
6,257,981 B1 7/2001 Acres et al.
6,264,555 B1 7/2001 Glazman et al.
6,287,197 B1 9/2001 Dickinson et al.
6,299,534 B1 10/2001 Breeding et al.
6,312,333 B1 11/2001 Acres
6,315,668 B1 11/2001 Metke
6,319,125 B1 11/2001 Acres
6,334,614 B1 1/2002 Breeding
6,358,149 B1 3/2002 Schneider et al.
6,364,768 B1 4/2002 Acres et al.
6,364,965 B1 4/2002 Masuda et al.
6,371,852 B1 4/2002 Acres
6,375,567 B1 4/2002 Acres
6,375,568 B1 4/2002 Roffman et al.
6,375,569 B1 4/2002 Acres
6,390,916 B1 5/2002 Brown
6,406,372 B1 6/2002 Turmell et al.
6,416,409 B1 7/2002 Jordan
6,431,983 B2 8/2002 Acres
6,435,968 B1 8/2002 Torango
6,439,995 B1 8/2002 Hughs-Baird et al.
6,450,887 B1 9/2002 Mir et al.
RE37,885 E 10/2002 Acres et al.
6,471,591 B1 10/2002 Crumby
6,488,505 B1 12/2002 Hightower
6,503,146 B2 1/2003 Walker et al.
6,508,709 B1 1/2003 Karmarkar
6,527,271 B2 3/2003 Soltys et al.
6,540,607 B2 4/2003 Mokris et al.
6,554,283 B2 4/2003 Vancura et al.
6,563,523 B1 5/2003 Suchocki et al.
6,565,434 B1 5/2003 Acres
6,565,435 B2 5/2003 Metke
6,575,832 B1 6/2003 Manfredi et al.
6,579,181 B2 6/2003 Soltys et al.
6,585,592 B1 7/2003 Crumby
6,592,460 B2 7/2003 Torango
6,595,854 B2 7/2003 Hughs-Baird et al.
6,599,193 B2 7/2003 Baerlocher et al.
6,605,003 B2 8/2003 Suchocki et al.
6,607,441 B1 8/2003 Acres
6,609,973 B1 8/2003 Weiss
6,620,046 B2 9/2003 Rowe
6,626,758 B1 9/2003 Parham et al.
6,638,167 B1 10/2003 Sawyer et al.
6,656,048 B2 12/2003 Olsen
6,692,005 B2 2/2004 Vancura et al.
6,692,353 B2 2/2004 Walker et al.
6,695,695 B2 2/2004 Angel
6,699,124 B2 3/2004 Suchocki
6,712,697 B2 3/2004 Acres
6,755,654 B2 6/2004 Hightower
6,800,030 B2 10/2004 Acres
6,824,135 B2 11/2004 Stancik
6,832,958 B2 12/2004 Acres et al.
6,837,788 B2 1/2005 Cannon
6,843,724 B2 1/2005 Walker et al.
6,846,238 B2 1/2005 Wells
6,878,063 B2 4/2005 Manfredi et al.
6,884,167 B2 4/2005 Walker et al.
6,910,964 B2 6/2005 Acres
6,923,440 B2 8/2005 Cherry
6,932,340 B1 8/2005 Schaefer et al.
6,932,701 B2 8/2005 Glavich et al.
RE38,812 E 10/2005 Acres et al.
7,025,674 B2 4/2006 Adams et al.
7,056,211 B2 6/2006 Taltavull et al.
7,070,505 B2 7/2006 Vancura et al.
7,077,746 B2 7/2006 Torango
7,097,562 B2 8/2006 Gagner
7,182,689 B2 2/2007 Hughs-Baird et al.
7,273,415 B2 9/2007 Cregan et al.
7,311,598 B2 12/2007 Kaminkow et al.
7,311,604 B2 12/2007 Kaminkow et al.
7,351,140 B2 4/2008 Wolf et al.
7,354,342 B2 4/2008 Paulsen et al.
7,357,716 B2 4/2008 Marks et al.
7,371,174 B2 5/2008 Baerlocher
7,377,849 B2 5/2008 Baerlocher et al.
7,390,263 B1 6/2008 Acres
7,393,280 B2 7/2008 Cannon
7,419,429 B2 9/2008 Taylor
7,427,236 B2 9/2008 Kaminkow et al.
7,448,949 B2 11/2008 Kaminkow et al.
2001/0034643 A1 10/2001 Acres
2001/0034649 A1 10/2001 Acres
2001/0046891 A1 11/2001 Acres
2002/0010015 A1 1/2002 Acres
2002/0061778 A1 5/2002 Acres
2002/0198044 A1 12/2002 Walker et al.
2003/0001338 A1 1/2003 Bennett et al.
2003/0036429 A1 2/2003 Witty et al.
2003/0104860 A1 6/2003 Cannon et al.
2003/0125107 A1 7/2003 Cannon
2003/0157978 A1 8/2003 Englman
2003/0186733 A1 10/2003 Wolf et al.
2003/0216166 A1 11/2003 Baerlocher et al.
2003/0222402 A1 12/2003 Olive
2003/0228904 A1 12/2003 Acres et al.
2004/0040723 A1 3/2004 Hovem
2004/0048644 A1 3/2004 Gerrard et al.
2004/0174366 A1 9/2004 Lenger et al.
2004/0242320 A1 12/2004 Jackson
2005/0026671 A1 2/2005 Baerlocher
2005/0032573 A1 2/2005 Acres et al.
2005/0054435 A1 3/2005 Rodgers et al.
2005/0064932 A1 3/2005 Cannon
2005/0101374 A1 5/2005 Acres
2005/0101384 A1 5/2005 Parham
2005/0119047 A1 6/2005 Olive

(56) References Cited

U.S. PATENT DOCUMENTS

2005/0143168 A1 6/2005 Torango
2005/0176488 A1 8/2005 Olive
2005/0176494 A1 8/2005 Thomas
2005/0187014 A1 8/2005 Saffari et al.
2005/0209004 A1 9/2005 Torango
2005/0209005 A1 9/2005 Acres et al.
2005/0239542 A1 10/2005 Olsen
2006/0019747 A1 1/2006 Loose et al.
2006/0025195 A1 2/2006 Pennington et al.
2006/0030403 A1 2/2006 Lafky et al.
2006/0040723 A1 2/2006 Baerlocher et al.
2006/0040732 A1 2/2006 Baerlocher et al.
2006/0040733 A1 2/2006 Baerlocher et al.
2006/0040734 A1 2/2006 Baerlocher et al.
2006/0040736 A1* 2/2006 Baerlocher ..... G07F 17/32 463/27
2006/0052160 A1 3/2006 Saffari et al.
2006/0068893 A1 3/2006 Jaffe et al.
2006/0073897 A1 4/2006 Englman et al.
2006/0079316 A1 4/2006 Flemming et al.
2006/0079317 A1 4/2006 Flemming et al.
2006/0084495 A1 4/2006 Jaffe et al.
2006/0084496 A1 4/2006 Jaffe et al.
2006/0089194 A1 4/2006 Joshi et al.
2006/0089196 A1 4/2006 Parham et al.
2006/0094495 A1 5/2006 Gelber et al.
2006/0116194 A1 6/2006 Pacey et al.
2006/0121969 A1 6/2006 Marks et al.
2006/0121971 A1 6/2006 Slomiany et al.
2006/0142079 A1 6/2006 Ikehara et al.
2006/0160612 A1 7/2006 Parham et al.
2006/0160625 A1 7/2006 Englman et al.
2006/0172804 A1 8/2006 Acres et al.
2006/0178203 A1 8/2006 Hughes et al.
2006/0183529 A1 8/2006 Acres et al.
2006/0183532 A1 8/2006 Jackson
2006/0183535 A1 8/2006 Marks et al.
2006/0189369 A1 8/2006 Taylor
2006/0211472 A1 9/2006 Walker et al.
2006/0211473 A1 9/2006 Walker et al.
2006/0211474 A1 9/2006 Walker et al.
2006/0211484 A1 9/2006 Hornik et al.
2006/0247006 A1 11/2006 Inamura
2007/0004494 A1 1/2007 Taylor
2007/0024005 A1 2/2007 Snow
2007/0026924 A1 2/2007 Taylor
2007/0032301 A1 2/2007 Acres et al.
2007/0054726 A1 3/2007 Muir et al.
2007/0054728 A1 3/2007 Hood
2007/0054732 A1 3/2007 Baerlocher
2007/0054733 A1 3/2007 Baerlocher
2007/0060271 A1 3/2007 Cregan et al.
2007/0060314 A1 3/2007 Baerlocher et al.
2007/0060320 A1 3/2007 Kelly et al.
2007/0060321 A1 3/2007 Vasquez et al.
2007/0060332 A1 3/2007 Anderson et al.
2007/0077990 A1 4/2007 Cuddy et al.
2007/0105619 A1 5/2007 Kniesteadt et al.
2007/0105620 A1 5/2007 Cuddy et al.
2007/0106553 A1 5/2007 Jordan et al.
2007/0111786 A1 5/2007 Snow
2007/0149292 A1 6/2007 Kaminkow et al.
2007/0155485 A1 7/2007 Cuddy et al.
2007/0167208 A1 7/2007 Acres
2007/0167217 A1 7/2007 Kaminkow et al.
2007/0184887 A1 8/2007 Cannon
2007/0191088 A1 8/2007 Breckner et al.
2007/0202943 A1 8/2007 Thomas
2007/0207847 A1 9/2007 Thomas
2007/0218975 A1 9/2007 Iddings et al.
2007/0218982 A1 9/2007 Baerlocher
2007/0218983 A1 9/2007 Lombardo
2007/0243923 A1 10/2007 Seelig et al.
2007/0254734 A1 11/2007 Gilmore et al.
2007/0259706 A1 11/2007 Anderson et al.
2007/0259713 A1 11/2007 Fiden et al.
2007/0265060 A1 11/2007 Hornik et al.
2007/0265092 A1 11/2007 Betteridge
2007/0293308 A1 12/2007 Jackson et al.
2007/0298856 A1 12/2007 Gilmore et al.
2007/0298874 A1 12/2007 Baerlocher et al.
2007/0298875 A1 12/2007 Baerlocher et al.
2008/0004104 A1 1/2008 Durham et al.
2008/0004105 A1 1/2008 Cregan et al.
2008/0015004 A1 1/2008 Gatto et al.
2008/0020817 A1 1/2008 Kaminkow et al.
2008/0020822 A1 1/2008 Cuddy et al.
2008/0020823 A1 1/2008 Cuddy et al.
2008/0020824 A1 1/2008 Cuddy et al.
2008/0020825 A1 1/2008 Cuddy et al.
2008/0020829 A1 1/2008 Baerlocher
2008/0020830 A1 1/2008 Ikehara et al.
2008/0020831 A1 1/2008 Ikehara et al.
2008/0020832 A1 1/2008 Iddings et al.
2008/0020833 A1 1/2008 Baerlocher et al.
2008/0020834 A1 1/2008 Breckner et al.
2008/0020846 A1 1/2008 Vasquez et al.
2008/0020847 A1 1/2008 Kniesteadt et al.
2008/0026812 A1 1/2008 Smith et al.
2008/0039191 A1 2/2008 Cuddy
2008/0039194 A1* 2/2008 Walther ..... G07F 17/32 463/25
2008/0045341 A1 2/2008 Englman
2008/0051168 A1 2/2008 Kaminkow et al.
2008/0051194 A1 2/2008 Parham et al.
2008/0058092 A1 3/2008 Schwartz et al.
2008/0058096 A1 3/2008 Parham et al.
2008/0070676 A1 3/2008 Baerlocher et al.
2008/0070677 A1 3/2008 Baerlocher et al.
2008/0070678 A1 3/2008 Baerlocher et al.
2008/0070702 A1 3/2008 Kaminkow et al.
2008/0076496 A1 3/2008 Baerlocher et al.
2008/0076514 A1 3/2008 Baerlocher et al.
2008/0076515 A1 3/2008 Baerlocher et al.
2008/0076517 A1 3/2008 Baerlocher et al.
2008/0076527 A1 3/2008 Low et al.
2008/0076531 A1 3/2008 Baerlocher et al.
2008/0076532 A1 3/2008 Graham et al.
2008/0076534 A1 3/2008 Iddings et al.
2008/0076542 A1 3/2008 Iddings et al.
2008/0076543 A1 3/2008 Parham et al.
2008/0076552 A1 3/2008 Baerlocher et al.
2008/0076576 A1 3/2008 Graham et al.
2008/0081690 A1 4/2008 Baerlocher et al.
2008/0081691 A1 4/2008 Baerlocher et al.
2008/0085771 A1 4/2008 Iddings et al.
2008/0085772 A1 4/2008 Iddings et al.
2008/0090651 A1 4/2008 Baerlocher
2008/0096640 A1 4/2008 Bennett et al.
2008/0096645 A1 4/2008 Frerking et al.
2008/0102916 A1 5/2008 Kovacs et al.
2008/0102920 A1 5/2008 Baerlocher
2008/0102942 A1 5/2008 Parham et al.
2008/0102943 A1 5/2008 Parham et al.
2008/0106037 A1 5/2008 Smith et al.
2008/0108401 A1 5/2008 Baerlocher et al.
2008/0108410 A1 5/2008 Baerlocher
2008/0108423 A1 5/2008 Benbrahim et al.
2008/0108426 A1 5/2008 Nguyen et al.
2008/0108430 A1 5/2008 Evans
2008/0108431 A1 5/2008 Cuddy et al.
2008/0111308 A1 5/2008 Snow
2008/0113699 A1 5/2008 Stevens et al.
2008/0113706 A1 5/2008 O'halloran
2008/0113738 A1 5/2008 Vallejo et al.
2008/0113765 A1 5/2008 Dewaal
2008/0113768 A1 5/2008 Baerlocher
2008/0113771 A1 5/2008 Baerlocher et al.
2008/0113779 A1 5/2008 Cregan
2008/0113784 A1 5/2008 Vallejo et al.
2008/0139274 A1 6/2008 Baerlocher
2008/0139290 A1 6/2008 Kniesteadt et al.
2008/0139316 A1 6/2008 He et al.
2008/0146322 A1 6/2008 Hardy et al.

(56) References Cited

U.S. PATENT DOCUMENTS

| | | | |
|---|---|---|---|
| 2008/0146323 | A1 | 6/2008 | Hardy et al. |
| 2008/0146325 | A1 | 6/2008 | Walker et al. |
| 2008/0146344 | A1 | 6/2008 | Rowe et al. |
| 2008/0146345 | A1 | 6/2008 | Hardy et al. |
| 2008/0146346 | A1 | 6/2008 | Hardy et al. |
| 2008/0153564 | A1 | 6/2008 | Baerlocher et al. |
| 2008/0167114 | A1 | 7/2008 | Graham |
| 2008/0167123 | A1 | 7/2008 | Luciano et al. |
| 2008/0176647 | A1 | 7/2008 | Acres |
| 2008/0176650 | A1 | 7/2008 | Wolf et al. |
| 2008/0182638 | A1 | 7/2008 | Paulsen et al. |
| 2008/0182650 | A1 | 7/2008 | Randall et al. |
| 2008/0182655 | A1 | 7/2008 | Dewaal et al. |
| 2008/0207298 | A1 | 8/2008 | Marks et al. |
| 2008/0207304 | A1 | 8/2008 | Acres |
| 2008/0207312 | A1 | 8/2008 | Seelig et al. |
| 2008/0207313 | A1 | 8/2008 | Acres |
| 2008/0214292 | A1 | 9/2008 | Bryant et al. |
| 2008/0220848 | A1 | 9/2008 | Adiraju et al. |
| 2008/0234047 | A1 | 9/2008 | Nguyen |
| 2008/0248867 | A1 | 10/2008 | Englman et al. |
| 2008/0268935 | A1 | 10/2008 | Acres |
| 2008/0268959 | A1 | 10/2008 | Bryson et al. |
| 2008/0293473 | A1 | 11/2008 | Fiden et al. |
| 2009/0005165 | A1 | 1/2009 | Arezina et al. |
| 2009/0011823 | A1 | 1/2009 | Englman et al. |
| 2009/0011824 | A1 | 1/2009 | Englman et al. |
| 2009/0011826 | A1 | 1/2009 | Acres |
| 2009/0011827 | A1 | 1/2009 | Englman et al. |

FOREIGN PATENT DOCUMENTS

| | | | |
|---|---|---|---|
| WO | WO 2001 051143 | A1 | 7/2001 |
| WO | WO 2005 016471 | A1 | 2/2005 |
| WO | WO 2006 063054 | A2 | 6/2006 |
| WO | WO 2006 104731 | A2 | 10/2006 |
| WO | WO 2007 082336 | A1 | 7/2007 |
| WO | WO 2007 089410 | A2 | 8/2007 |
| WO | WO 2008 143790 | A2 | 11/2008 |

OTHER PUBLICATIONS

Alfastreet M8 description, Alfa street Gaming Instruments, available on or before Nov. 13, 2006.

Arctic Thunder Videogame by Midway, retrieved from website at http://www.klov.com/game_detail.php?game_id=6906, available on or before Dec. 31, 2001.

Atropic Systems Progressive Products at G2E, published by Atropic in 2004, printed from ForRelease.com.

Bally Live-Server Based Gaming brochure, written by Bally Gaming Systems, published in 2006.

Cash Express Advertisements, written by Aristocrat, published in 2002.

FAST BUCK Systems Manual, written by International Game Technology, available to Mirage shift supervisors at least as early as May 30, 1990.

Hot Shot Progressive Article, written by Strictly Slots, published in Feb. 2006.

Hydro Thunder Videogame by Midway, retrieved from website at http://www.klov.com/game_detail.php?game_id=8161, available on or before Dec. 31, 1999.

Jackpot Carnival Hyperlink Advertisement, written by Aristocrat, published prior to 2002.

Jackpot Party Brochure and Articles written by WMS Gaming, Inc, published in 1998.

Offroad Thunder Videogame by Midway, retrieved from website at http://www.klov.com/game_detail.php?game_id=8911, available on or before Dec. 31, 2000.

PEM—Precision Electronic Meter, written by GRIPS Electronic GmbH, printed from website reported as archived on Feb. 20, 1997 (available at http://web.archive.org/web/19970220165753/www.grips.com/pem.htm).

Player Tracking on Slots, written by GRIPS Electronic GmbH, printed from website reported as archived on Feb. 20, 1997 (available at http://web.archive.org/web/19970220165921/www.grips.com/playtrac.htm).

ProLINK Progressive Controller User/Reference Manual, written by Casino Data Systems, published in Apr. 1997.

Wide Area Progressive Link System, written by GRIPS Electronic GmbH, printed from website reported as archived on Feb. 20, 1997 (available at http://web.archive.org/web/19970220165457/www.grips.com/wap.htm).

Zorro Advertisement, written by Aristocrat, published in 2004.

Third Party Submission in Published Application Under 37 C.F.R. § 1.99 filed for U.S. Appl. No. 13/323,353, dated Jun. 11, 2012 (2 pages).

Partial U.S. Pat. No. 6,609,973 submitted with Third Party Submission in Published Application Under 37 C.F.R. § 1.99 filed for U.S. Appl. No. 13/323,353 (3 pages).

Partial U.S. Patent Application Publication No. 2006/0247006 submitted with Third Party Submission in Published Application Under 37 C.F.R. § 1.99 filed for U.S. Appl. No. 13/323,353 (3 pages).

* cited by examiner

FIG. 5

130

| QUANTITY OF ACTIVE PLAYERS | NUMBER OF GAMING MACHINES | AWARD GROUP | AVAILABLE AWARDS |
|---|---|---|---|
| 1 TO 2 | 8 | 1 | $12,105.56<br>$25,245.48<br>$44,810.17 |
| 3 TO 5 | 8 | 2 | $34,920.78<br>$60,276.29<br>$197,041.94 |
| 6 TO 8 | 8 | 3 | $514,006.77<br>$752,437.84<br>$5,176,849.35 |

FIG. 7A

144

| QUANTITY OF ACTIVE PLAYERS | NUMBER OF GAMING MACHINES | AWARD GROUP | AVAILABLE AWARDS |
|---|---|---|---|
| 1 TO 5 | 20 | 1 | 25X |
| 6 TO 10 | 20 | 2 | $1,000<br>$2,000 |
| 11 TO 15 | 20 | 3 | $5,000<br>$10,000<br>$15,000 |
| 16 TO 20 | 20 | 4 | $10,482,921.71 |

FIG. 7B

146

| QUANTITY OF ACTIVE PLAYERS | NUMBER OF GAMING MACHINES | AWARD GROUP | AVAILABLE AWARDS |
|---|---|---|---|
| 1 TO 2 | 4 | 1 | FIRST BONUS EVENT OR BONUS AWARD |
| 3 | 4 | 2 | SECOND BONUS EVENT OR BONUS AWARD |
| 4 | 4 | 3 | THIRD BONUS EVENT OR BONUS AWARD |

FIG. 7C

148

| QUANTITY OF ACTIVE PLAYERS | NUMBER OF GAMING MACHINES | AWARD GROUP | AVAILABLE AWARDS |
|---|---|---|---|
| 1 TO 5 | 20 | 1 | INCREASE PAYBACK PERCENTAGE BY 1% |
| 6 TO 10 | 20 | 2 | INCREASE PAYBACK PERCENTAGE BY 3% |
| 11 TO 15 | 20 | 3 | INCREASE PAYBACK PERCENTAGE BY 5% |
| 16 TO 20 | 20 | 4 | INCREASE PAYBACK PERCENTAGE TO AT LEAST 100% |

GAMING SYSTEM AND METHOD FOR PROVIDING A BONUS BASED ON NUMBER OF GAMING MACHINES BEING ACTIVELY PLAYED

PRIORITY CLAIM

This application is a continuation of, claims the benefit of and priority to U.S. patent application Ser. No. 13/324,661, filed on Dec. 13, 2011, which is a divisional of, claims the benefit of and priority to U.S. patent application Ser. No. 12/138,203, filed on Jun. 12, 2008, which claims priority to and the benefit of U.S. Provisional Patent Application No. 60/986,092, filed on Nov. 7, 2007, the entire contents of which are each incorporated by reference herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Symbols or symbol combinations which are less likely to occur usually provide higher awards.

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machines generally indicates this to the player through one or more visual and/or audio output devices, such as the reels, lights, speakers, video screens, etc. Part of the enjoyment and excitement of playing certain gaming machines is the occurrence or triggering of the secondary or bonus game (even before the player knows how much the bonus award will be). In other words, obtaining a bonus event and a bonus award in the bonus event is part of the enjoyment and excitement for players.

Progressive awards associated with gaming machines are also known. In one form, a progressive award is an award amount which includes an initial amount and an additional amount funded through a portion of each wager made on the progressive gaming machine. For example, 0.1% of each wager placed on the primary game of a gaming machine may be allocated to the progressive award or progressive award fund. The progressive award grows in value as more players play the gaming machine and more portions of the players' wagers are allocated to the progressive award. When a player obtains a winning symbol or symbol combination which results in the progressive award, the accumulated progressive award is provided to the player. After the progressive award is provided to the player, the amount of the next progressive award is reset to the initial value and a portion of each subsequent wager is allocated to the next progressive award.

A progressive award may be associated with a single gaming machine or multiple gaming machines which each contribute portions of the progressive award. The multiple gaming machines may be in the same bank of machines, in the same casino or gaming establishment (usually through a local area network ("LAN")) or in two or more different casinos or gaming establishments (usually through a wide area network ("WAN")). Such progressive awards are sometimes called local area progressives ("LAP") and wide area progressives ("WAP"), respectively.

Mystery bonus awards are also known. Such bonus awards are classified as mystery awards because they are not based on any generated symbol or symbol combination nor is it readily apparent to the player why such bonus award(s) are provided. One type of known mystery bonus award is associated with a range of values. For this type of mystery bonus award, a triggering event occurs and a progressive award is provided to a player of a gaming device in the gaming system when that progressive award increments or increases to a designated value (i.e., the progressive hit value) within the range of values associated with that progressive award. For example, a first progressive award is associated with a value range of $10 to $100 wherein, a triggering event will occur and the first progressive award will be provided to a player when the value of the first progressive award increments to a first progressive hit value of $54.65. It should be appreciated that the amount which this progressive award may be incremented to is capped or limited by the highest value in the value range associated with such progressive award.

While such mystery progressive awards are popular amongst players, a number of problems exist with these known mystery progressive award gaming systems. For example, when a progressive award is provided at another gaming machine, a player may feel deflated and not wish to continue playing for a base or reset level progressive award. Such feelings can lead to certain players walking away with jackpot fatigue. That is, jackpot fatigue can occur when a player no longer finds an award desirable or worth the cost of continuing to play. This desire to quit playing is also due to the fact that a player may feel they must wait a substantial period of time for the progressive award to climb back to a high value.

There is a continuing need to provide new and different gaming machines and gaming systems as well as new and different ways to provide awards to players including bonus and progressive awards.

SUMMARY

Various embodiments of the gaming system includes a plurality of gaming machines or gaming devices in communication with a central server, central controller or remote host. In one embodiment, the central server monitors or controls a designated quantity (i.e., a bank or designated group) of gaming devices in the gaming system. The central server monitors each of the banks or designated groups of gaming devices to track the quantity of players actively playing at one of the gaming devices in each of the banks or designated groups. The central server changes (i.e., increases or decreases) the awards or the type of awards associated with each bank or designated group based on the quantity of active players playing at gaming devices in the bank or designated group.

In one embodiment, the awards available to each active player at a bank of gaming devices increase as more active players begin play at the bank of gaming devices. For example, if two active players are playing at gaming devices in the bank of such devices, the central server associates a first award or award pool with the bank, which makes the first award or award pool available to the two active players of that bank. If five active players are playing at gaming devices in the bank, the central server associates a second, different award or award pool with the bank, which makes the second, different award or award pool available to the five active players of that bank. In various embodiments, the second, different award or award pool includes awards of higher value, a higher frequency, and/or a higher probability of occurring than the first award or award pool. In one embodiment, the eligibility of such first and second awards or award pools is based on the quantity or number of players actively playing at the gaming devices of the bank(s) or designated group of gaming devices.

In different embodiments, the central server of the gaming system disclosed herein is operable to track or otherwise account for the quantity of active players playing at least one game at a designated quantity of the gaming devices. The determination of whether a player is active or inactive may be one or more occurrences of any suitable event which occurs in association with (a) one or more plays of one or more primary games at one or more of the gaming devices, (b) one or more plays of one or more secondary games at one or more of the gaming devices, and/or (c) one or more occurrences at one or more of the gaming devices which are independent of any primary or secondary games played. Additionally, in different embodiments, the determination or designation of whether a player is active or inactive may be randomly determined, predetermined, determined based on the player tracking status or ranking (obtained via a player tracking system) associated with that player, determined based on the type of games the player plays, determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on the amount of coin-in accumulated in one or more pools, or determined based on any other suitable method or criteria.

In one embodiment, the gaming system disclosed herein includes at least one award, award pool or award level adapted to be provided to a player of one of a plurality of gaming devices. In operation, the central server determines or tracks the quantity of players actively playing at one or more gaming devices in the gaming system. The gaming devices may be tracked in banks or designated groups of such gaming devices. In this instance, the central server tracks the quantity of players actively playing at least one game at one or more gaming devices in a designated bank or group of gaming devices in the gaming system. In one embodiment, the central server tracks a wager or a player identification for each player at the different gaming devices. Upon the central server determining that the tracked quantity of active players has reached a designated quantity or threshold, the central controller causes each gaming device in the designated bank or group of gaming devices to increase the associated at least one award, award pool or award level. By linking each gaming device in a bank or designated group, the gaming system disclosed herein is operable to identify and track any active players at any of the linked gaming devices, and modify the at least one award, award pool or award level based on the quantity of active players. Such a configuration tracks different quantities of active players, and ties these quantities to the award amount or award type available for each active player at such linked gaming devices.

In one embodiment, the gaming system includes a plurality of progressive awards adapted to be provided to one or more players of the gaming devices in the gaming system. In one embodiment, the progressive awards are grouped into different progressive award pools. In this instance, each different progressive award pool includes at least one, and preferably, a plurality of such progressive awards. Each progressive award pool is associated with a designated quantity of players actively playing at the gaming devices. For example, a first progressive award pool is associated with a first quantity of players actively playing at the gaming devices (e.g., one to three players) and a second progressive award pool is associated with a second quantity of players actively playing at the gaming devices (e.g., four to six players). As more players actively play at the gaming devices, the central server provides access to different progressive award pools, preferably including at least one progressive award of a higher value.

In operation, the central server determines which progressive award pool the active players qualify for. The central server controls at least one game at the gaming devices to provide an opportunity for the active players to play for at least one progressive award of the determined progressive award pool. The at least one game is played by the active players in association with the determined progressive award pool. The central server provides one of the progressive awards of the determined progressive award pool based on the occurrence of one or more different triggering or qualifying conditions. In one embodiment, the one or more different triggering or qualifying conditions are in association with the at least one game. For example, one of the first quantity of active players reaches a designated triggering or qualifying condition in association with the at least one game and the central server provides a first progressive award of a first progressive award pool to that player. In one embodiment in accordance with this example, the player who was provided the first progressive award and the other active players can still play for at least one second progressive award of the first progressive award pool. In one embodiment, the at least one second progressive award of the first progressive award pool has a higher value than the first progressive award, but both the first and second progressive awards are associated with the first progressive award pool. By including progressive awards in different award pools which are accessible by different quantities of active players, the gaming system is more likely to be offering at least one progressive award that a player views as worth trying for or valuable.

In one embodiment, at least one of the progressive awards in the gaming system is associated with a quantity or number of active players at gaming devices in the gaming system. In this embodiment, the central server tracks a quantity or number of players actively playing at the gaming devices in the gaming system, such as tracking a wager or player identification for each player at the different gaming devices. Once the central server tracks or determines the quantity of active players, the central server offers the at least one progressive award based on the quantity of active players playing each primary or secondary game at each participating gaming device. In one embodiment, the central server increments a counter or meter to track such active players and causes at least one display device to display any active progressive awards (i.e., those associated with the current quantity of active players) in addition to any other inactive progressive awards (i.e., those associated with other quantities of active players different than the current quantity). For example, a first progressive award or award pool is associated with one to two players, a second progressive award or award pool is associated with three to five players, and a third progressive award or award pool is associated with six to eight players. If the central server increments the meter to two to represent two active players, the central server associates the first progressive award or award pool with at least one game provided to those active players. If a third player becomes active at the gaming devices, the central server increments the meter to three, and associates the second progressive award or award pool with at least one game provided to the three active players. To award each progressive award, in one embodiment, the central server tracks an event in association with the at least one game with a separate meter or counter. Once one of the active players reaches a designated number of events in the primary or secondary game at the participating gaming devices in the gaming system, the central server provides the progressive award associated with the quantity of active players to one of the players at one of the gaming devices in the gaming system. Accordingly, the gaming system disclosed herein associates at least one progressive award with a quantity of players at participating gaming devices in the gaming system and provides the at least one progressive award to a player based on a number of occurrences of an event tracked in association with one or more player's gaming experiences.

In one embodiment, each active player is associated with the same progressive award or progressive award pool based on the quantity of active players at participating gaming devices in the gaming system. A separate threshold of traceable events must occur (and is tracked by the central server accordingly) to trigger a gaming device to provide that progressive award to a player. In this embodiment, upon the central server determining that the quantity of occurrences of a tracked events has reached a threshold (i.e., a progressive award triggering event has occurred), the gaming system provides the progressive award associated with the quantity of active players to one of the players that is actively playing one of the gaming devices in the gaming system.

Accordingly, an advantage of the gaming system and method disclosed herein is to provide a gaming system and method having a plurality of gaming devices which increases a value, a frequency, or a probability associated with an award based on the quantity of players actively playing at participating gaming devices. Such a gaming system and method provides increased participation, excitement and enjoyment to players because the players have the opportunity to win progressive awards of a higher value or more often as more players become active at the participating gaming devices.

Another advantage of the gaming system and method disclosed herein is to provide a gaming system and method having a plurality of gaming devices wherein one or more progressive awards may be provided to one or more players either sequentially, simultaneously or substantially simultaneously. Maintaining a plurality of progressive awards provides for more frequent wins of the progressive awards which breaks up the relatively long periods of time it often takes to build the progressives to the appropriate levels desirable by a player. Providing a plurality of different progressive awards which are triggered or hit at different times or based on different and/or independent triggering events results in always or almost always having at least one progressive award available that is incremented to desirable levels. Providing different types of progressive awards which have different frequencies of being hit therefore provides increased enjoyment and excitement for players.

Additional features and advantages are described in, and will be apparent from, the following Detailed Description and the figures.

BRIEF DESCRIPTION OF THE FIGURES

FIG. 5 is an example table for utilization in one embodiment of the gaming system disclosed herein illustrating a number of active players at a designated quantity of gaming devices in the gaming system and at least one award associated with the gaming devices based on the number of active players.

FIGS. 7A, 7B, and 7C are example tables for utilization in one embodiment of the gaming system disclosed herein illustrating a number of active players at a designated quantity of gaming devices in the gaming system and at least one award associated with the gaming devices based on the number of active players.

DETAILED DESCRIPTION

The present disclosure may be implemented in various configurations for gaming machines, gaming devices or gaming systems, including but not limited to: (1) a dedicated gaming machine, gaming device, or gaming system, wherein the computerized instructions for controlling any games (which are provided by the gaming machine or gaming device) are provided with the gaming machine or gaming device prior to delivery to a gaming establishment; and (2) a changeable gaming machine, gaming device, or gaming system, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
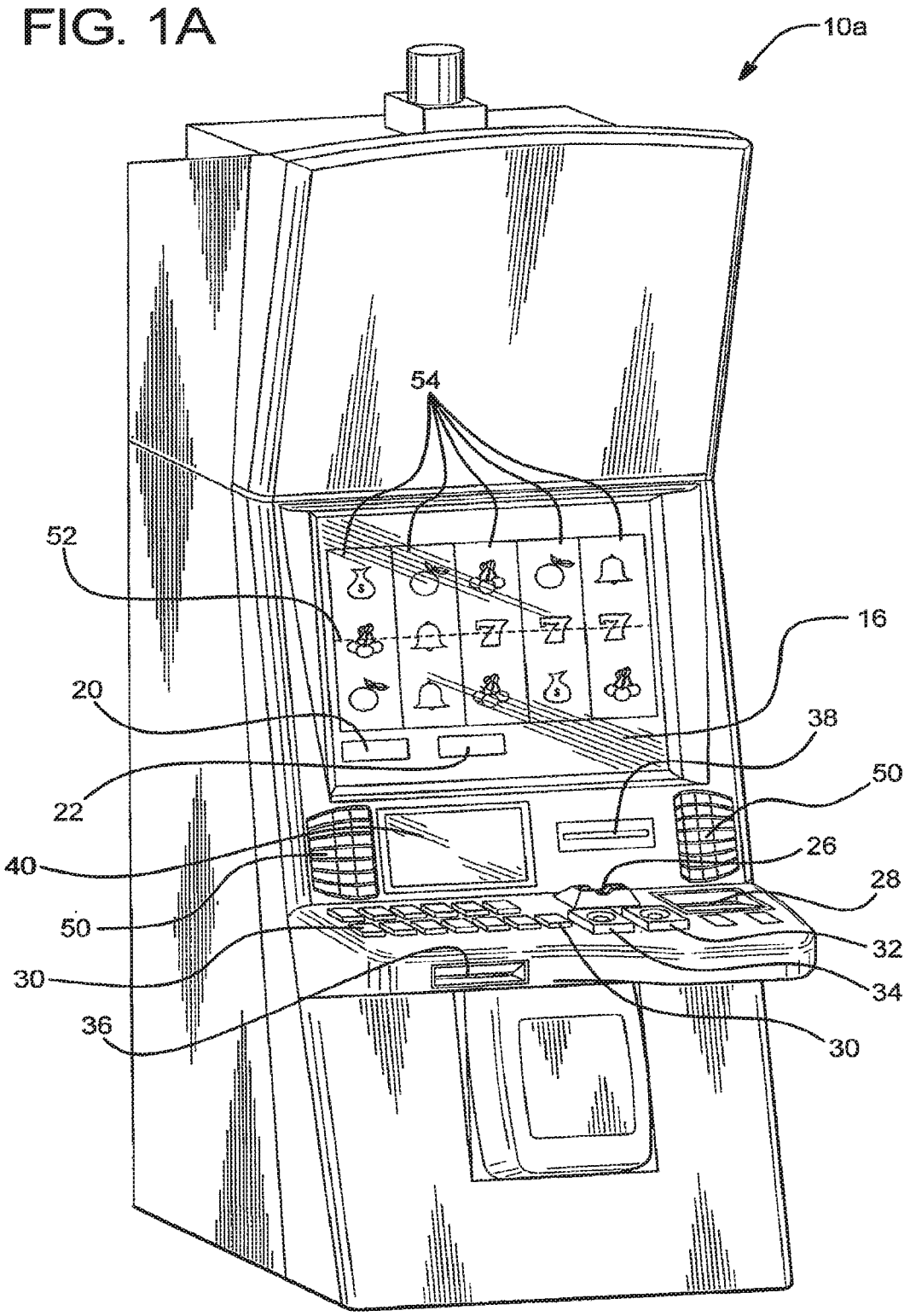
FIG. 1A is a front-side perspective view of one embodiment of the gaming device disclosed herein.
Figure 1B:
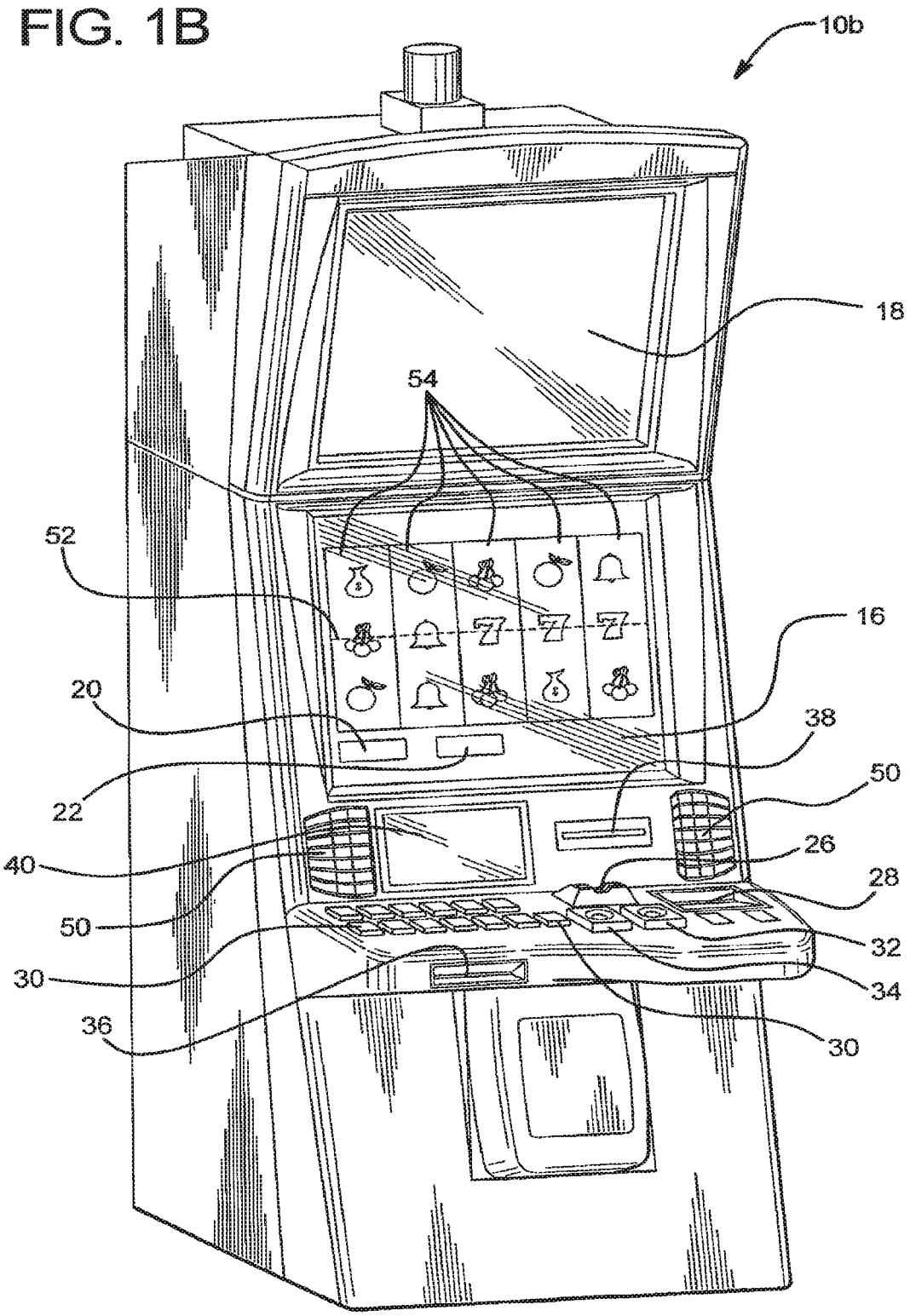
FIG. 1B is a front-side perspective view of another embodiment of the gaming device disclosed herein.

Referring now to the drawings, two example alternative embodiments of the gaming device disclosed herein are illustrated in FIGS. 1A and 1B as gaming device 10*a*, and gaming device 10*b*, respectively. Gaming device 10*a*, and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
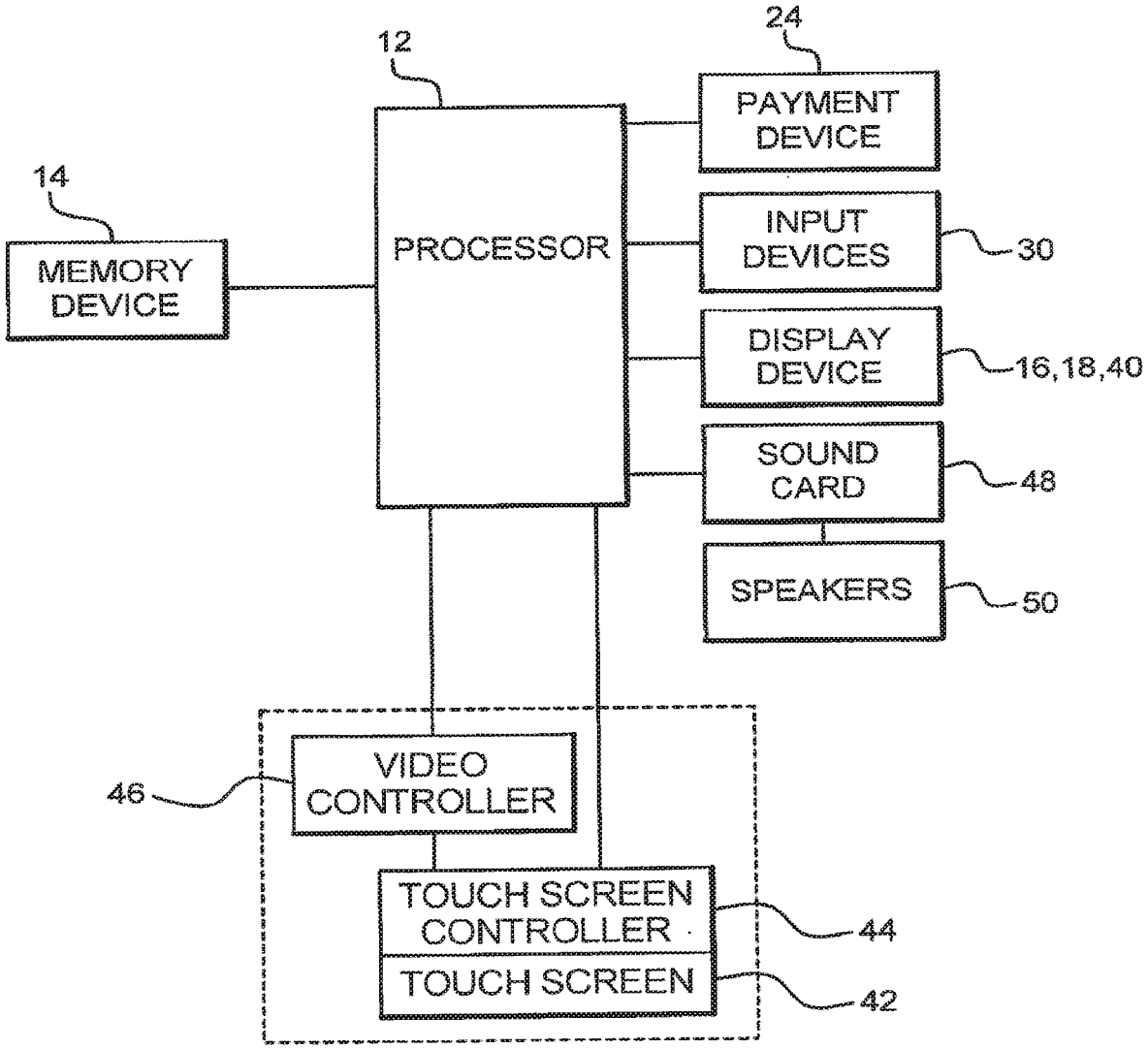
FIG. 2A is a schematic block diagram of the electronic configuration of one embodiment of the gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a player's playing tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card may be implemented in accordance with the gaming device disclosed herein.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
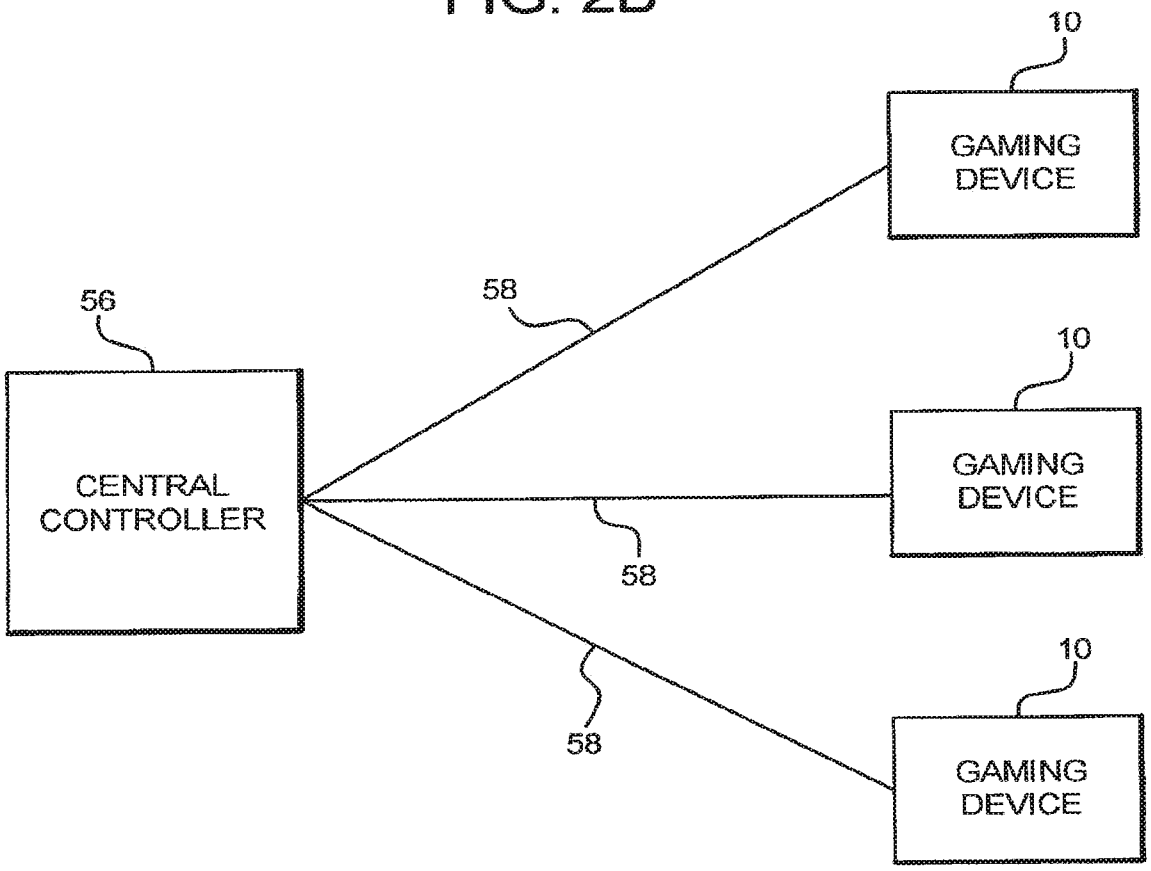
FIG. 2B is a schematic block diagram illustrating a plurality of gaming terminals in communication with a central controller.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any players gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts and/or the time these wagers are placed. In different embodiments, for one or more players, the player tracking system includes the player's account number, the player's card number, the player's first name, the player's surname, the players preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Awards Provided to Player

In one embodiment, a plurality of gaming devices at one or more gaming sites are networked to the central server in a progressive configuration, wherein a portion of each wager placed is allocated to one or more progressive awards. In one embodiment, the progressive awards are associated with the system gaming machines which each contribute portions of the progressive awards. In one such embodiment, different progressive awards are associated with different numbers of gaming devices. For example, a progressive award valued at $10,000 may be associated with ten gaming devices while another progressive award valued at $500,000 may be associated with one-hundred gaming devices. In one embodiment, the multiple gaming machines may be in the same bank of machines, in the same casino or gaming establishment such as through LAN or in two or more different casinos or gaming establishments such as through a WAN. In another embodiment, each individual gaming machine maintains one or more progressive awards wherein a portion of each wager placed at that respective gaming machine is allocated to one or more progressive awards maintained by such individual gaming machine. In another embodiment, each individual gaming machine maintains one or more progressive awards and the central server simultaneously or substantially simultaneously maintains one or more progressive awards. In one such embodiment, the lower valued, more frequently triggered progressive awards are maintained by the individual gaming machines and the higher valued, less frequently triggered progressive awards are maintained by the central server.

In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state. In one embodiment, the host site computer is maintained for the overall operation and control of the system. In this embodiment, a host site computer oversees all or part of the progressive gaming system and is the master for computing all or part of the progressive jackpots. All participating gaming sites report to, and receive information from, the host site computer. Each central server computer is responsible for all data communication between the gaming device hardware and software and the host site computer.

In one embodiment, more than one of the progressive awards start at the same level, such as $1000 and increment or increase until provided to a player. In another embodiment, more than one of the progressive awards start at different levels such as $10, $100, $1000 and $10,000 and increment or increase until provided to a player. The progressive awards accumulate based on a small percentage (such as 0.1%) of coin-in or wagered amounts in a conventional manner. In one embodiment, the percentage that goes to each progressive award is equal (such as 0.1% to each of four progressive awards). At this accrual rate, player wagers totaling $1,000,000 are required for the progressive to reach $1000. In one embodiment, at least a fraction of this amount may be funded by the casino by using a starting value higher than zero to make the progressives attractive even after they are reset. In other embodiments, two or more of the progressive awards may be funded by different percentages. In these embodiments, the central server and/or individual gaming device processor continues to increase the progressive levels until a progressive award is provided to a player (upon the occurrence of a progressive award triggering event), at which point the progressive is reset and another progressive award starts incrementing from the appropriate default progressive award level. In another embodiment, two or more of the progressive awards may be funded at different temporal rates. In this embodiment, the different progressive awards are incremented or funded in different increments of time wherein until the progressive hits, a set amount is added to the progressive at each determined time increment. In another embodiment, two or more of the progressive awards may each be incremented or funded based on different incrementing factors or incrementors. In this embodiment, a first of the progressive awards may increment each time a first incrementing factor occurs and a second of the progressive awards may increment each time a second incrementing factor occurs, wherein the first incrementing factor and the second incrementing factor are different. Examples of incrementing factors could be a symbol-driven trigger in the base game, the player betting a maximum amount, a percentage of possible gaming machines being actively played or in active status, or any other suitable method for defining an incrementor.

In one embodiment, one or more of the progressive awards are funded, at least partially, via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed. In another embodiment, one or more progressive awards are funded, at least partially, via an amount provided by one or more marketing and/or advertising departments, such as a casino's marketing department.

In one embodiment, the central server or other central controller determines when one or more progressive award wins are triggered. In this embodiment, a central controller and an individual gaming machine work in conjunction with each other to determine when a progressive award win is triggered, for example through an individual gaming machine meeting a predetermined requirement or criteria established by the central controller. In another embodiment, an individual gaming machine may determine when one or more progressive award wins are triggered. In another embodiment, an individual gaming machine may determine when at least one progressive award win is triggered and the central controller determines when at least one progressive award win is triggered.

In one embodiment, different gaming devices in the gaming system have different progressive awards available to a player. In one such embodiment, different types of gaming devices are associated with different types of progressive awards based on the current configuration of the gaming system.

In one embodiment, zero, one or more progressive awards are locally available to designated gaming devices and zero, one or more other progressive awards are available throughout the gaming system. For example, a first progressive award (e.g., a first type of progressive award) is game specific and available to gaming devices having a designated game, such as video poker. A second progressive award (e.g., a second type of progressive award) is available system wide to a plurality of gaming devices independent of the primary and/or secondary games of the gaming devices. In one embodiment, one or more of the gaming devices are associated with at least one first progressive award (e.g., a first type of progressive award) and at least one second progressive award (e.g., a second type of progressive award).

In one embodiment, zero, one or more progressive awards may be associated with each of the gaming devices in the gaming system while zero, one or more different progressive awards may be associated with a plurality of, but not all of the gaming devices in the gaming system. For example, both a first set of gaming devices and a second, different set of gaming devices may be associated with a first type of progressive award which is provided based on a quantity or number of tracked occurrences reaching a designated threshold amount, but the first set of gaming devices is also associated with a second type of progressive award (which the second set of gaming devices is not) which is provided based on a quantity or number of different tracked occurrences reaching a designated threshold amount. Such different progressive awards available significantly increases the probability that at least one incremented progressive award will be available at any time as well as significantly increases the probability that, at any given time, the gaming system will be offering at least one progressive award that a player views as valuable or worth trying for. In one embodiment, the gaming devices of the gaming system are operable to provide multiple progressive awards to multiple players at the multiple linked gaming devices at the same time or substantially the same time. Alternatively, the gaming devices of the gaming system are operable to provide multiple progressive awards to multiple players at the multiple linked gaming devices in an overlapping or sequential manner.

In one embodiment, at least one and preferably a plurality of the progressive awards maintained by the gaming system are provided to players of the linked gaming machines in an apparently random fashion as perceived by the players of these gaming machines. These progressive awards are distinguished from the awards that the gaming machines provide to the players for winning outcomes in the plays of the primary wagering games, such as slot games, card games (e.g., poker, blackjack) or any other suitable game.

In one embodiment, the gaming devices do not provide any apparent reasons to the players for obtaining such progressive awards. In this embodiment, providing the progressive awards is not triggered by an event in the primary game or based specifically on any of the displayed plays of any primary game or on any of the displayed plays of any secondary game of the gaming machines in the system. That is, these progressive awards are provided to the players without any explanation or alternatively with simple explanations.

In one embodiment, at least one progressive award is associated with at least one suitable event which occurs in association with a player's gaming experience and is independent of any values of any primary game wagers placed. In another embodiment, a plurality of progressive awards are associated with a plurality of suitable events which occur in association with a player's gaming experience and is independent of any values of any primary game wagers placed. In different embodiments, which progressive award is associated with which suitable events which occur in association with a player's gaming experience is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria. In one embodiment, a progressive award amount of each progressive award is an amount of coin-in accumulated in one or more pools, as described below.

Figure 3:
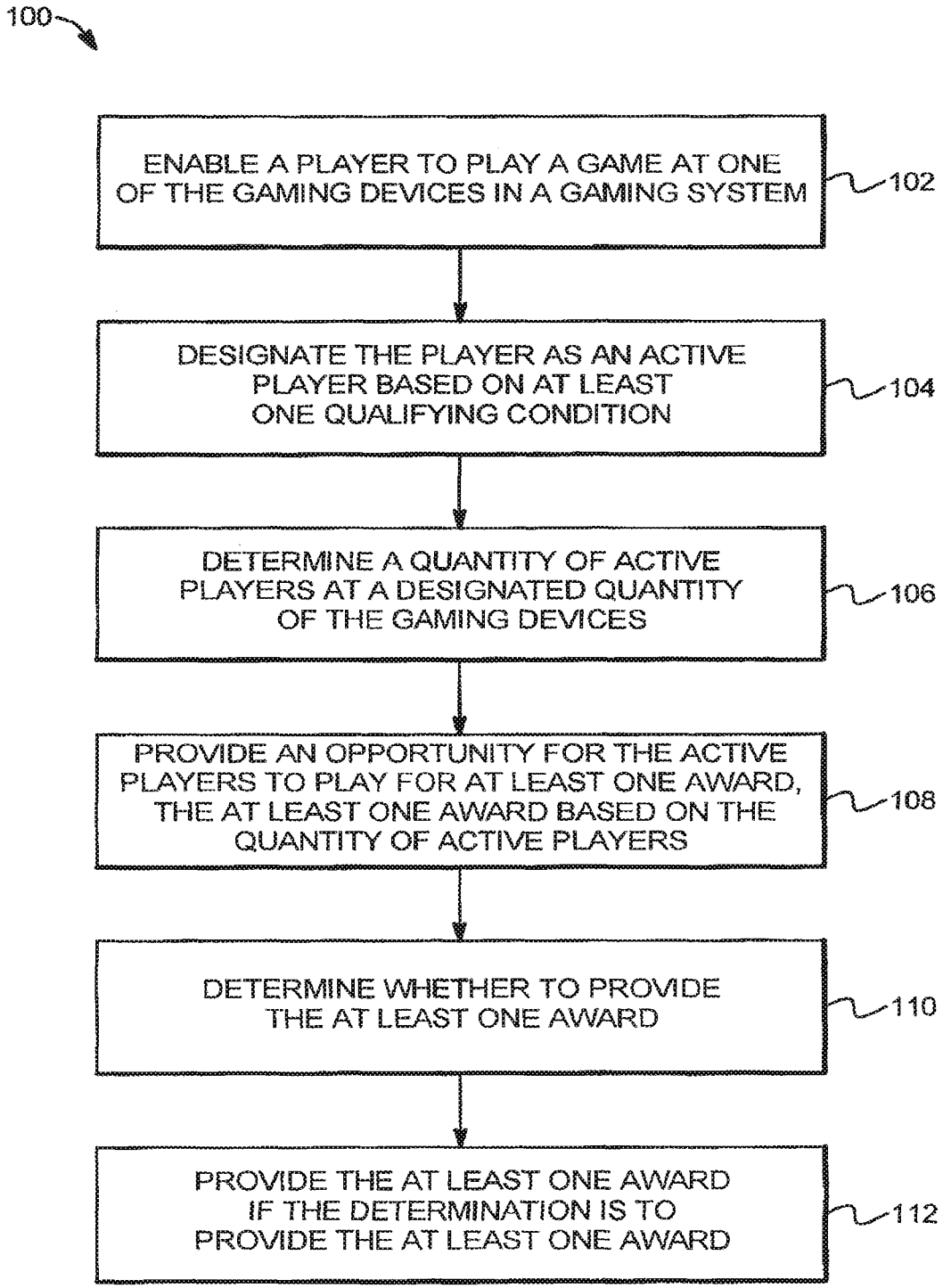
FIG. 3 is a flow-chart of one embodiment of the gaming system disclosed herein illustrating a tracked quantity of active players at a designated quantity of the gaming devices and a determination of whether to provide a player at least one award based on the tracked quantity of active players.

In operation of one embodiment of the gaming system disclosed herein, the central controller and/or gaming device processor enables a player to initiate game play, play a game or otherwise suitably interact with one of the gaming devices in the gaming system, as indicated in block 102 of FIG. 3. In this embodiment, the gaming device being suitably interacted with by the player is part of a designated quantity or group of gaming devices. Gaming devices may be part of the designated quantity or group based on any suitable factor, such as location, game type, denomination, payback percentage, manufacturer, theme, and maximum wager. The central controller monitors and tracks a quantity of such players at gaming devices associated with the designated quantity or group. In one embodiment, the central controller monitors and controls each gaming device in the gaming system. In another embodiment, a plurality of central controllers monitor and control different banks or designated groups of gaming devices.

As indicated in block 104, the central controller designates one or more players of the gaming devices in the designated quantity or group as an active player based on at least one qualifying condition. The determination or designation of whether a player is active or inactive may be one or more occurrences of any suitable event which occurs in association with (a) one or more plays of one or more primary games at one or more of the gaming devices, (b) one or more plays of one or more secondary games at one or more of the gaming devices, and/or (c) one or more occurrences at one or more of the gaming devices which are independent of any primary or secondary games played.

In one embodiment, such events may be determined based on any player (or a designated player) placing a wager (regardless of the wager amount). In one such embodiment, a minimum wager level is required for a player to be designated as active. In one embodiment, this minimum wager level is the maximum wager level for the primary game in the gaming machine. In another embodiment, no minimum wager level is required for a player to be designated as active.

In other embodiments, such events may be randomly determined, predetermined, affected by the player tracking status or ranking (obtained via a player tracking system) associated with that player, affected by the type of games the player plays, determined based on a deposit of an amount of funds at the gaming device, determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on the amount of coin-in accumulated in one or more pools, or determined based on any other suitable method or criteria. It should be appreciated that such events may occur in association with the initiation of game play, the play of a game or the otherwise suitable interaction with one of the gaming devices. By implementing a central server, central controller or remote host to track such occurrences, the gaming system and method disclosed herein provides that the determination or designation of whether a player is active or inactive may occur in association with any event or occurrence which is part of the player's gaming experience.

In one embodiment, each gaming device communicates data regarding each gaming event occurring at that gaming device to the central controller. In this embodiment, the central controller analyzes such data and designates the player of that gaming device as an active player or an inactive player. In another embodiment, as described above, the central controller communicates to each eligible or participating gaming device data regarding which gaming events to track. In this embodiment, each gaming device communicates data to the central controller regarding such central controller tracked gaming events which occur at that gaming device. The central controller analyzes such data and designates the player of that gaming device as an active player or an inactive player.

As indicated in block 106 of FIG. 3, the central controller determines a quantity of the active players at the designated quantity or group of the gaming devices. For example, if the designated quantity or group of the gaming devices includes eight gaming devices, the central controller determines how many of such gaming devices are being interacted with by an active player as described above with respect to block 104. In one embodiment, zero, one, a plurality of, or all of the gaming devices are being interacted with by an active player. The central controller counts or determines the quantity of active players at the gaming devices of the designated quantity or group.

As seen in FIG. 3, after the central controller determines the quantity of the active players at gaming devices in the designated quantity or group, the central controller provides an opportunity for the active players to play for at least one award. The at least one award is based on the determined quantity of active players at gaming devices in the designated quantity or group, as indicated in block 108 of FIG. 3. In one embodiment, the central controller provides a play of at least one game to the active players. In this embodiment, the at least one game is associated with the at least one award, which is based on the determined quantity of active players at gaming devices in the designated quantity or group, as indicated in block 108.

In one embodiment, the central controller associates different awards with different quantities of active players based on certain thresholds. For example, if one or two active players are at the gaming devices of the designated bank or group, the central controller provides an opportunity for the active players to play for a first award. If three to five active players are at the gaming devices of the designated bank or group, the central controller provides an opportunity for the active players to play for a second award. The second award may have a higher value or a higher probability of occurring than the first award. Similarly, if six to eight players are at the gaming devices of the designated bank or group, the central controller provides an opportunity for the active players to play for a third award. The third award may have a higher value or a higher probability of occurring than the second award.

It should be appreciated that different awards or award pools are associated with different quantities of active players based, at least in part, on the amount of the award. The quantities of active players, the type of the awards, the quantity of awards available, the amounts of the awards and/or the any probability associated with the awards can change or be set as desired by the gaming system operator. For example, a first award pool having a plurality of relatively low awards is associated with one or two active players, a second award pool having a plurality of relatively medium awards is associated with three to five active players, and a third award pool having relatively high awards is associated with six to eight active players. By setting different ranges of quantities of active players which must be met to play for different awards or award pools, the gaming system provides incentive for increased player participation.

In one embodiment, different awards are associated with different probabilities of being provided based, at least in part, on the quantity of active players. In one such embodiment, the quantity of active players changes the available awards and/or the probability of being provided one of the available awards. The following table illustrates an example configuration of such embodiment where the central controller associates each quantity of active players with a set of awards having a probability of being provided to one of the active players.

| Quantity of Active Players | Award | Probability of being provided |
|---|---|---|
| 1 to 4 | Small | 60% |
| | Medium | 30% |
| | Large | 10% |
| 5 to 10 | Small | 40% |
| | Medium | 40% |
| | Large | 20% |
| 11 or more | Small | 30% |
| | Medium | 30% |
| | Large | 40% |

As seen in the above table, as more players become active, the probability of being provided medium and large awards increases for the players. In one embodiment, additional awards become available as more players become active. For example, an award may have a 0% probability of being provided when 1 to 5 players are designated as being active (e.g., unavailable) and may have a 10% probability of being provided when 6 or more players are active (e.g., available). The awards and probabilities associated with each quantity of active players is determined by the gaming system operator.

In one embodiment, the quantity of active players affects which type of awards are available to the players. For example, if 1 to 5 players are designated as being active, one or more fixed awards (e.g., non-progressive awards) are available. In this example, if 6 or more players are designated as active, one or more progressive awards are available. In this embodiment, different types of awards are associated with different quantities of active players.

In one embodiment, the quantity of active players affects which quantity of awards are available. For example, if 1 to 10 players are designated as being active, a first quantity of awards is available and if 11 to 20 players are designated as being active, a second quantity of awards is available. In this example, the second quantity of awards is greater than the first quantity of awards so that as more players become active, the players have an opportunity to play for a greater number of awards. In one such embodiment, the quantity of awards available corresponds to, or is at least based on, the quantity of active players.

In another embodiment, the quantity of gaming machines in a bank of gaming devices determines which quantity of awards are available. For example, if 5 gaming machines are part of a designated bank, a first quantity of awards is available (e.g., five awards) and if 10 gaming machines are part of the designated bank, a second quantity of awards (e.g., ten awards) is available. In this example, the second quantity of awards is greater than the first quantity of awards so that as more gaming devices become active in the designated bank, the players playing at the gaming devices have an opportunity to play for a greater number of awards. In one such embodiment, the quantity of awards available corresponds to, or is at least based on, the quantity of active gaming devices in the designated bank.

It should be appreciated that the award or awards described above may be displayed or indicated in different ways. In one embodiment, all of the awards are displayed or indicated to one or more players playing at the gaming devices in the gaming system. In another embodiment, at least one of the awards is displayed or indicated as being winnable or awardable to one or more players playing at the gaming devices in the gaming system. For example, the gaming system highlights, changes the color of, or indicates in any suitable manner the winnable or awardable awards. In this embodiment, one or more of the awards may also be displayed or indicated as not being winnable or awardable to one or more players playing at the gaming devices in the gaming system. That is, an indicated or displayed award may not be winnable or awardable to a player because a designated quantity of players and/or gaming devices are not yet active. Additionally, an award which is not yet winnable or awardable to a player because a designated quantity of players and/or gaming devices are not active may or may not be displayed or indicated by the gaming system.

The award or awards described above may be any suitable award such as, but not limited to, a value, an award pool including one or more awards, one or more multipliers, one or more modifiers, one or more anti-terminators, one or more offers to accept or reject, one or more plays of one or more games utilizing an enhanced paytable, one or more additional player picks in a selection game, one or more activations of an award generator, one or more retriggers, one or more nudges, a number of free games, or a replay of one or more previous games, one or more non-progressive awards, one or more progressive awards, one or more bonus events, and a higher payback percentage associated with a primary or bonus game. In different embodiments, the at least one award is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on time (such as the time of day), determined based on an amount of coin-in accumulated in one or more pools or determined based on any other suitable method or criteria.

In one embodiment, as mentioned above, the awards are progressive awards which accumulate based on a small percentage (such as 0.1%) of coin-in or wagered amounts. In one embodiment, one or more of the progressive awards are funded with only side-bets or side-wagers placed. In another embodiment, one or more of the progressive awards are funded based on player's wagers as described above as well as any side-bets or side-wagers placed. In another embodiment, one or more progressive awards are funded, at least partially, via an amount provided by one or more marketing and/or advertising departments, such as a casino's marketing department.

In one embodiment, the central controller monitors the gaming devices in the gaming system during a designated period of time. During this period, the central controller tracks wagers at the gaming devices. When the period ends, the central controller communicates with the gaming devices to determine a quantity of active players. In one embodiment, the central controller increments each progressive award based on a percentage of coin-in or wagered amounts at the gaming devices during the period. For example, each progressive award is incremented according to an increment rate based on the percentage of coin-in or wagered amounts at the gaming devices during the period. In one embodiment, the central controller increments a designated progressive award based on a percentage of coin-in or wagered amounts at the gaming devices during the period. In this embodiment, the designated progressive award is associated with the quantity of active players. For example, if the quantity of active players is between 1 and 5 players, the central controller increments a first progressive award (or level) and if the quantity of active players is greater than or equal to 6 players, the central controller increments a second, different progressive award (or level).

In one embodiment, the progressive awards (or levels) are triggered by the same triggering events. In another embodiment, at least two of the progressive awards (or levels) are triggered by different triggering events. For example, each progressive award (or level) could be triggered by a separate and different triggering event. In one embodiment, a single player can win any of the active progressive awards.

The central controller determines whether to provide the at least one award in association with the opportunity or game provided to the active players, as indicated by block 110 of FIG. 3. In one embodiment, the determination is based on a tracked gaming event that occurs in association with the opportunity or game provided to the active players. For example, if an active player achieves a designated number of bonus symbols during one or more plays of the game, the central controller determines to provide the at least one award to the active player. In this embodiment, the central controller increments an event meter associated with the occurred tracked event. After incrementing the event meter, the central controller determines if the incremented event meter has reached a threshold of occurrences of tracked events. When the incremented event meter has reached the threshold of occurrences of tracked events, the central controller provides the at least one award to the active player, as indicated by block 112 of FIG. 3.

In one embodiment, each award is associated with a separate range of quantities for a gaming event. In this embodiment, depending on the amount or the type of the award, the central server selects a quantity within the range of quantities for the gaming event to function as a threshold quantity. It should be appreciated that different awards are associated with different ranges based, at least in part, on the frequency at which those awards are provided. For example, a relatively frequently provided award, such as a low award or a first level award pool, is associated with a first range of quantities (e.g., 5 to 10) and a relatively infrequently provided award, such as a high award or a high level award pool, is associated with a second range of quantities (e.g., 50 to 75). In this example, the gaming event associated with the relatively frequently provided award must occur 5 to 10 times before the central controller provides that award to the player. By setting different ranges of quantities of gaming events which must be accumulated to provide different awards or award pools, the gaming system provides that different awards or award pools are associated with different probabilities of being provided to players.

In one embodiment, the threshold of occurrences of a tracked gaming events is determined by a gaming system operator. In different embodiments, the threshold of occurrences of a tracked events is predetermined, randomly determined, determined based on the player's status (such as determined through a player tracking system), determined based on a generated symbol or symbol combination, determined based on a random determination by the central controller, determined based on a random determination at the gaming machine, determined based on a weighted parameter, determined based on a determined subset range, determined based on one or more side wagers placed, determined based on the player's primary game wager, determined based on time (such as the time of day), determined based on an amount of coin-in accumulated in one or more pools or determined based on any other suitable method or criteria.

If the central controller determines that the incremented event meter has not reached the threshold of occurrences of tracked events, the gaming system does not provide the player the award associated with the tracked gaming event. In this case, the central controller and/or gaming device processor enables a play of the game to proceed at that gaming device in any suitable manner.

Figure 4:
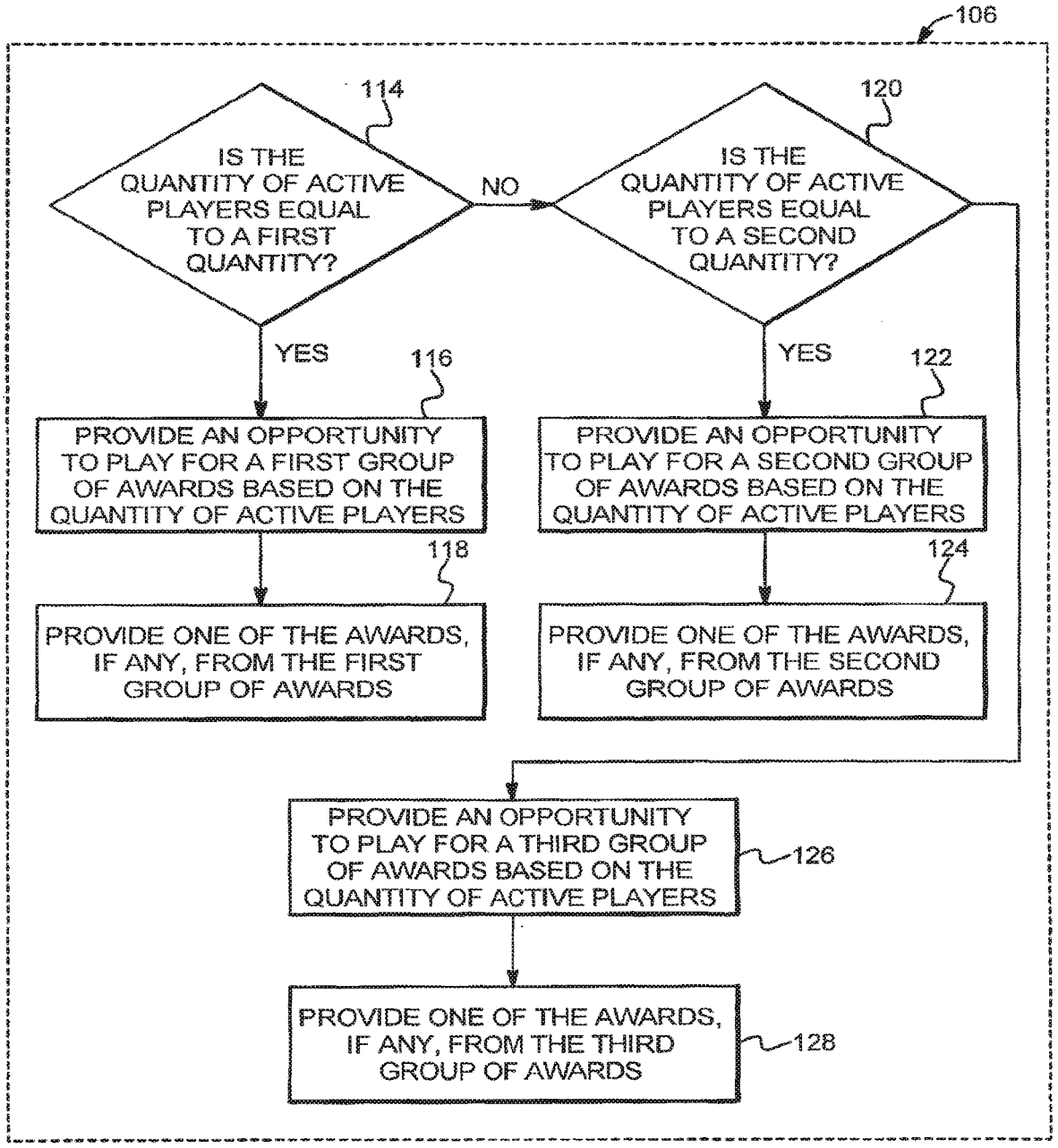
FIG. 4 is a flow-chart of one embodiment of the gaming system disclosed herein illustrating a tracked quantity of active players at a designated quantity of the gaming devices and an association of an award group selected from a plurality of award groups based on the tracked quantity of active players.

In one embodiment, as described above with respect to block 106 of FIG. 3, the central controller determines a quantity of the active players at the designated quantity or group of the gaming devices. In one embodiment illustrated in FIG. 4, the gaming system and method disclosed herein associate an award group selected from a plurality of award groups based on a tracked quantity of active players at a designated quantity of the gaming devices. The sequence illustrated in FIG. 4 is described in conjunction with table 130 illustrated in FIG. 5. Table 130 includes a plurality of award groups or pools associated with different determined quantities of active players at a designated quantity or group of the gaming devices. As illustrated in table 130 of FIG. 5, each quantity of active players (from a minimum number of players to a maximum number of players) is associated with one of the award groups. The association between the quantity of active players and each award group may be determined by a gaming system operator or by any other suitable manner.

The sequence illustrated in FIG. 4 is described for three quantities of active players, each being associated with a separate award group. It should be appreciated that sequence illustrated in FIG. 4 and the example table 130 illustrated in FIG. 5 may be adapted for any suitable number of quantities of active players at any number of gaming devices, wherein the quantities of active players are associated with any number of separate award groups (or awards). In one such embodiment, the determination to provide any awards to active players is independent of any wagers made by such active players.

The central controller determines whether the determined quantity of active players equals a first quantity, as indicated by decision diamond 114 of FIG. 4. If the determined quantity of active players equals the first quantity, the central controller provides an opportunity or game associated with a first group of awards to the determined quantity of active players, as indicated by block 116 of FIG. 4. The first group of awards includes a plurality of awards available to the active players in the opportunity or game. The awards of the first group are based on the determined quantity of active players at the designated quantity or group of the gaming devices. As indicated by block 118 of FIG. 4, the central controller provides one of the awards, if any, from the first group of awards based on a qualifying condition, such as an accumulated total of tracked gaming events described above.

If the determined quantity of active players does not equal the first quantity, the central controller determines whether the determined quantity of active players equals a second quantity, as indicated by decision diamond 120 of FIG. 4. If the determined quantity of active players equals the second quantity, the central controller provides an opportunity or game associated with a second group of awards to the determined quantity of active players, as indicated by block 122 of FIG. 4. The second group of awards includes a plurality of awards available to the active players in the opportunity or game. The awards of the second group are based on the determined quantity of active players at the designated quantity or group of the gaming devices. As indicated by block 124 of FIG. 4, the central controller provides one of the awards, if any, from the second group of awards based on a qualifying condition, such as an accumulated total of tracked gaming events described above.

If the determined quantity of active players does not equal the second quantity, the central controller provides an opportunity or game associated with a third group of awards to the determined quantity of active players, as indicated by block 126 of FIG. 4. The third group of awards includes a plurality of awards available to the active players in the opportunity or game. The awards of the third group are based on the determined quantity of active players at the designated quantity or group of the gaming devices. As indicated by block 128 of FIG. 4, the central controller provides one of the awards, if any, from the third group of awards based on a qualifying condition, such as an accumulated total of tracked gaming events described above.

It should be appreciated that the qualifying condition for the second or third group may be different from the qualifying condition for the first group. In one embodiment, the qualifying conditions for the first, the second, and the third groups may require different quantities of the same gaming event. For example, the qualifying condition for the first group may require ten bonus symbols to occur at the gaming device of one of the active players, the qualifying condition for the second group may require twenty bonus symbols to occur at the gaming device of one of the active players, and the qualifying condition for the third group may require thirty bonus symbols to occur at the gaming device of one of the active players. In another embodiment, the qualifying conditions for the first, the second, and the third groups may require different gaming events and different quantities of the same gaming event. For example, the qualifying condition for the first group may require two cherry symbols to occur at the gaming device of one of the active players, the qualifying condition for the second group may require four bonus symbols to occur at the gaming device of one of the active players, and the qualifying condition for the third group may require eight bonus symbols to occur at the gaming device of one of the active players.

In one embodiment, the first, second and third award groups each include a plurality of progressive awards. Table 130 illustrated in FIG. 5 illustrates example award groups including progressive awards. The first award group includes progressive awards having values of $12,105.56, $25,245.48, and $44,810.17. The second award group includes progressive awards having values of $34,920.78, $60,276.29, and $197,041.94. The third award group includes progressive awards having values of $514,006.77, $752,437.84, and $5,176,849.35. By offering progressive awards of different amounts in the same award group, the gaming system significantly increases the probability that, at any given time, the gaming system will be offering at least one progressive award that a player views as worth trying for or valuable. In this embodiment, once the gaming system provides one of the progressive awards from the first, second, or third award group is award pools to one of the active players, the value of this progressive award is reset to a default value and starts incrementing from the default progressive award level.

In one embodiment, the progressive award associated with the tracked gaming event is provided to the player who caused the incremented event meter to increment to its respective threshold. In another embodiment, the progressive award associated with the tracked gaming event is provided to a player different than the player who caused the incremented event meter to increment to its respective threshold. In different embodiments, the player whom is provided the progressive award associated with the tracked gaming event is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, the full value of the progressive award associated with the tracked event is provided to a player. In another embodiment, part, but not all of the value of the progressive award associated with the tracked event is provided to a player. In one such embodiment, to account for different players wagering different amounts (and having equal or substantially equal probabilities of winning a progressive award), the amount of the progressive award associated with the tracked event which is provided to a player is based on the amount of the player's wager. In different embodiments, the amount of the progressive award associated with the tracked event which is provided to a player is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on time (such as the time of day), determined based on an amount of coin-in accumulated in one or more pools or determined based on any other suitable method or criteria.

Figure 6A:
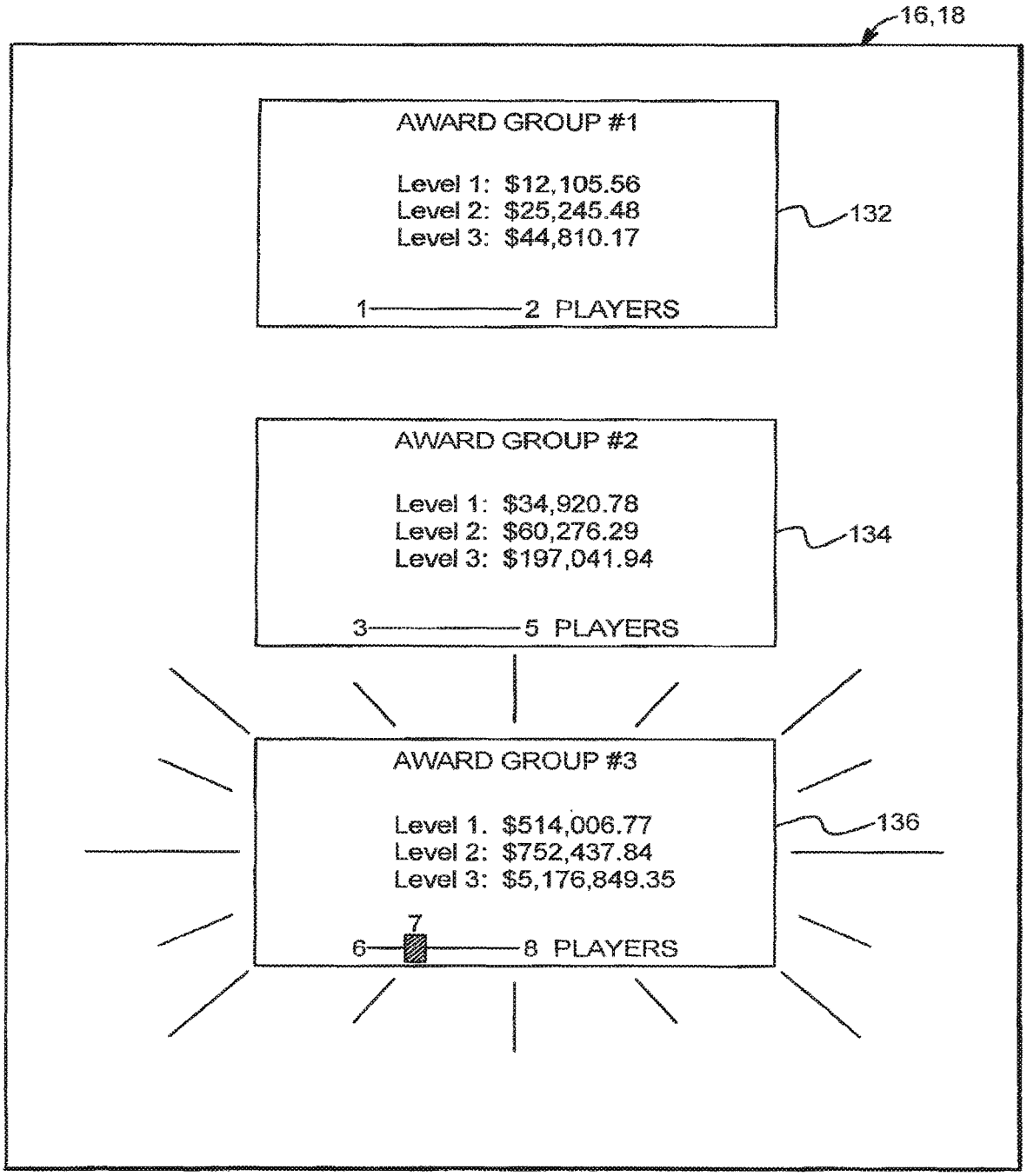
FIGS. 6A, 6B, 6C, 6D, and 6E are top plan views of a display device of one embodiment of a gaming device disclosed herein illustrating at least one progressive award which may be won by an active player and the different criteria necessary to win such progressive awards.

One example embodiment of the gaming system disclosed herein includes a progressive award associated with a quantity of active players at a designated quantity of gaming devices. As illustrated in FIG. 6A, a first award group 132 is associated with a quantity of 1 or 2 active players. The first award group 132 includes one or more multi-level progressive awards, currently valued at $12,105.56, $25,245.48, and $44,810.17. A second award group 134 is associated with a quantity of 3, 4, or 5 active players. The second award group 134 includes one or more multi-level progressive awards, currently valued at $34,920.78, $60,276.29, and $197,041.94. A third award group 136 is associated with a quantity of 6, 7, or 8 active players. The third award group 136 includes one or more multi-level progressive awards, currently valued at $514,006.77, $752,437.84, and $5,176,849.35. The central controller monitors a designated quantity of gaming devices, such as eight gaming devices in this example. The central controller compares the quantity of active players at the designated quantity of gaming devices to a designated threshold to determine which of the award groups 132, 134, and 136 to associate with the quantity of active players. The current quantity of active players, the current value of the progressive awards, and the designated quantity of the gaming devices may or may not be displayed to the players.

FIG. 6A illustrates at least one display device 16 or 18 of one of the designated quantity of gaming devices. It should be appreciated that the same display may be displayed at the display devices 16 or 18 of each gaming device being played by one of the active players. The following description illustrates the display device 16 or 18 of one of the gaming devices for one of the active players.

The central controller causes the display device 16, 18 to display the award groups 132, 134, and 136 to the player. An indication of which award group is associated with (e.g., selected by the central controller based on) the current quantity of active players at the designated quantity of gaming devices. In one embodiment, the central controller communicates with the gaming machine processor associated with the display device 16 or 18 (e.g., via messaging or other suitable data communication) to display the total quantity of players, the total quantity of active players, and any association with the award groups 132, 134, and 136. In different embodiments, the indication can be displayed graphically on the display device 16 or 18 in any suitable form. As illustrated in FIG. 6A, the quantity of currently active players is seven players which is associated with the third award group 136. In this example, the central controller associates the third award group 136 with a game or other opportunity for the active players to play for the progressive awards of the third award group 136.

In one embodiment, the game or other opportunity for the active players to play for the progressive awards is a bonus game that is triggered upon a suitable triggering event. In one embodiment, a triggering event occurs and the central controller provides the bonus game to each active player (or at least one gaming device in the gaming system associated with each active player is provided with the game) based on a predefined variable reaching a defined parameter threshold. For example, a triggering event for the bonus game occurs on the 500,000$^{th}$ play of a gaming machine associated with the bonus game (ascertained from a tracking system or meter associated with the gaming machine). In different embodiments, the predefined parameter thresholds include a length of time, a length of time after a certain dollar amount is hit, a wager level threshold for a specific machine (which gaming device is the first to contribute $250,000), a number of gaming machines active, or any other parameter that defines a suitable threshold.

In another embodiment, a triggering event occurs and the central controller provides the bonus game to each active player (or at least one gaming device in the gaming system associated with each active player is provided with the game) based on time. In this embodiment, a time is set for when the bonus game will occur. In one embodiment, such a set time is based on historic data. For example, if previous games have been triggered after approximately sixty-seven days, the bonus game may be set to trigger sixty-seven days from when the bonus game was last triggered. In one embodiment, a suitable algorithm is implemented to determine the player who wagered at or closest to this time with tie-breaking based on any number of factors (e.g., player tracking history, amount of or recent wagers placed). In this embodiment, the bonus game is provided to the player who the algorithm determined wagered closest to when the bonus game is triggered. In another embodiment, one of the players who wagered during a designated time period is randomly selected and the bonus game award is provided to the selected player.

In another embodiment, a triggering event occurs and the central controller provides the bonus game to each active player (or at least one gaming device in the gaming system associated with each active player is provided with the game) based upon gaming system operator defined player eligibility parameters stored on a player tracking system (such as via a player tracking card or other suitable manner). For example, a gaming system operator may choose to only enable players of the highest player tracking status to be eligible for the game. In this embodiment, the parameters for eligibility are defined by the gaming system operator based on any suitable criterion. In one embodiment, the central controller/gaming device processor recognizes the player's identification (via the player tracking system) when the player inserts their player tracking card in the gaming machine. The central server/gaming device processor determines the player tracking level of the player and if the current player tracking level defined by the gaming system operator is eligible for the game. In one embodiment, the gaming system operator defines minimum bet levels required for the bonus game based on the player's card level. In another embodiment, as described above, different side bets or side-wager amounts are required to be eligible to receive different progressive award levels associated with the game. Once the central controller/gaming device processor determines which players are eligible, any suitable method for providing the bonus game may be employed.

Another embodiment for determining a triggering event for the bonus game includes a system determination, wherein the bonus game is provided due to a random selection by the central controller. In one embodiment, the central controller tracks all active gaming machines and the wagers they placed. Each gaming machine has its own entry defining its state as either active or inactive and also defining the values of the wagers from that gaming machine. Based on the gaming machine's state as well as one or more wager pools associated with the gaming machine, the central controller determines which of these gaming machines provides the game. The player who consistently places a higher wager is more likely to receive an opportunity to play the bonus game than a player who consistently places a minimum wager.

In another embodiment, a triggering event occurs and the central controller provides the bonus game to each active player (or at least one gaming device in the gaming system associated with each active player is provided with the game) by determining if any numbers allotted to a gaming device match a randomly selected number. In this embodiment, upon or prior to each play of each gaming machine, a gaming device selects a random number from a range of numbers and during each primary game, the gaming machine allocates the first N numbers in the range, where N is the number of credits bet by the player in that primary game. At the end of the primary game, the randomly selected number is compared with the numbers allocated to the player and if a match occurs, that particular gaming machine provides the bonus game to one of the active players.

Figure 6B:
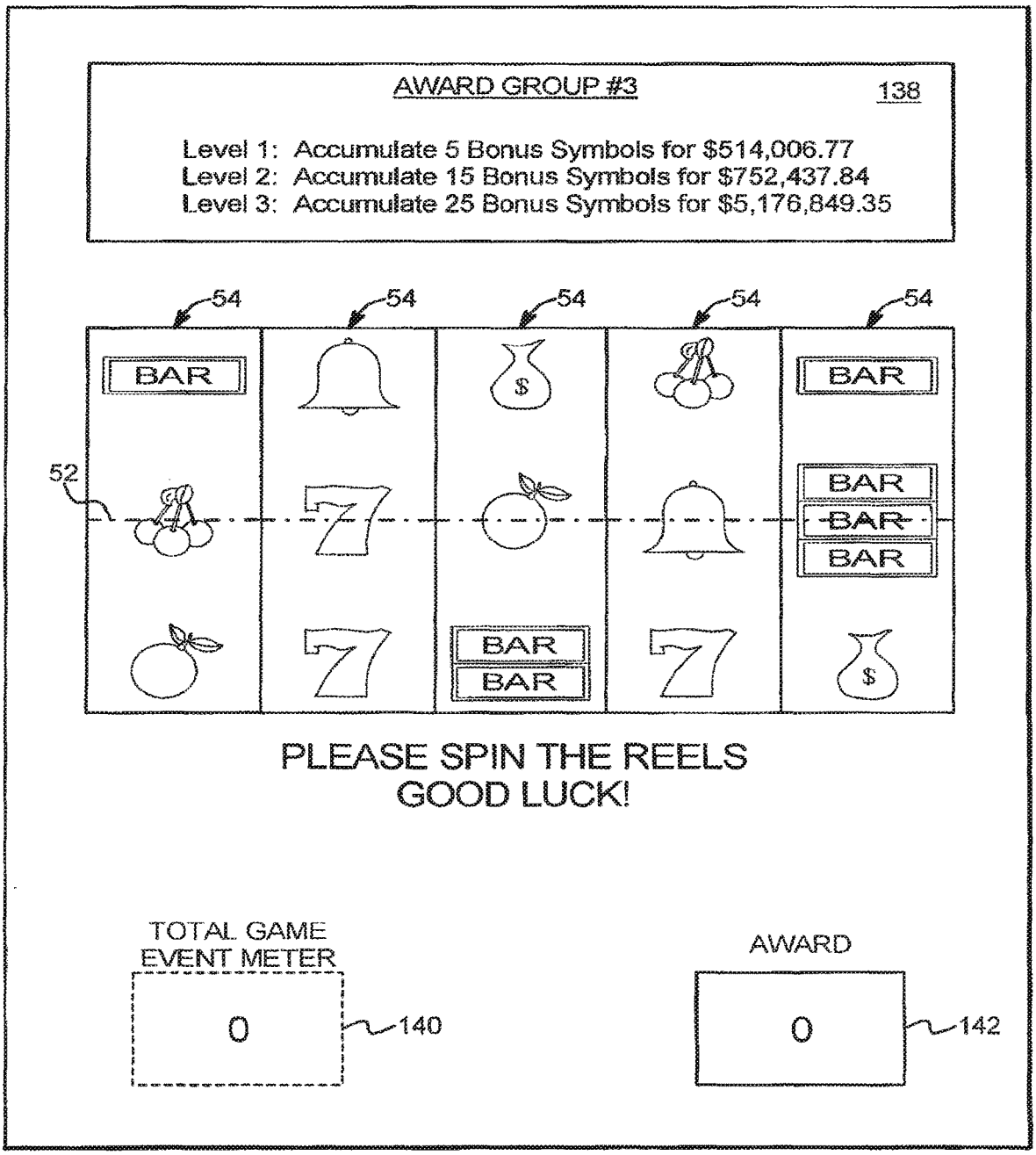

As seen in FIG. 6B, the at least one display device 16 or 18 illustrates a display area 138 which informs the players of a designated threshold required to win each of the progressive awards of the third award group. As illustrated, a first progressive award is associated with a first level of a multi-level progressive award. The first progressive award is valued at $514,006.77 and requires five bonus symbols to be accumulated before the central controller provides the first progressive award to one of the active players. The second progressive award is valued at $752,437.84 and requires fifteen bonus symbols to be accumulated before the central controller provides the second progressive award to one of the active players. The third progressive award is valued at $5,176,849.35 and requires twenty-five bonus symbols to be accumulated before the central controller provides the third progressive award to one of the active players.

As described above, the occurrence or generation of a bonus symbol on the reels 54 of each gaming device is a gaming event tracked by a total game event meter 140. The total game event meter 140 is displayed by the display device 16 or 18 to inform the player of progress toward each of the progressive awards indicated in the display area 138. As seen in FIG. 6B, the gaming device includes a plurality of symbols and generates symbol combinations which may or may not be associated with any awards (according to an applicable paytable). An award meter 142 displays an award of zero and the total game event meter 140 displays the total game events to be zero. Appropriate messages such as "PLEASE SPIN THE REELS! GOOD LUCK" may be provided to the player visually, or through suitable audio or audiovisual displays. Upon a suitable input by the player, such as a wager for a primary game, or activation of a "spin the reels" button for a bonus game, the central controller activates the reels 54 to spin.

Figure 6C:
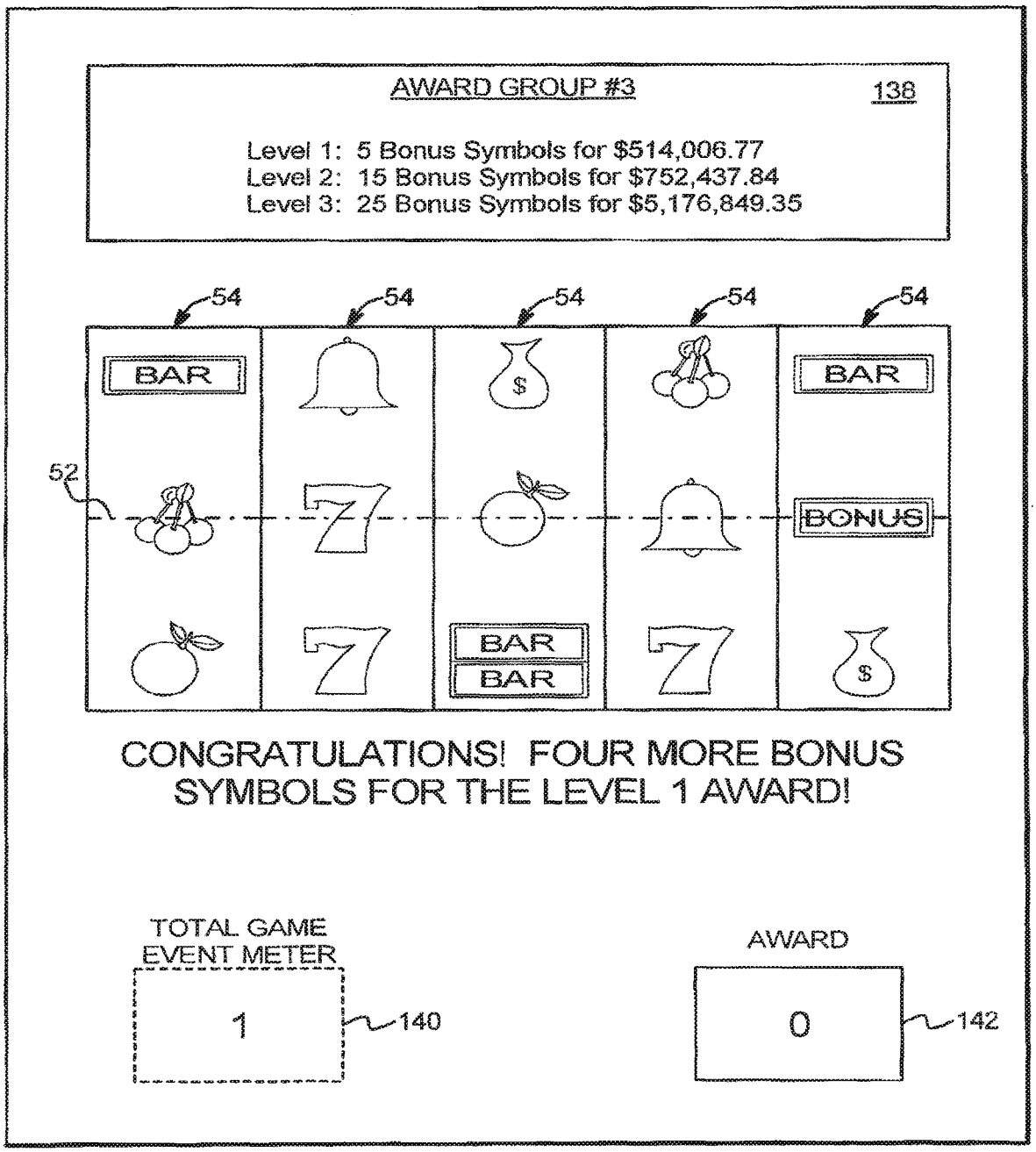

As seen in FIG. 6C, the gaming device generated symbol combinations which included one bonus symbol on payline 52 associated with the reels 54. The total game event meter 140 increments by one and displays the total game events as one (which does not meet the threshold for any of the progressive awards displayed by area 138). The award meter 142 displays an award of zero since the player has not accumulated enough bonus symbols to win one of the progressive awards. Appropriate messages such as "CONGRATULATIONS! FOUR MORE BONUS SYMBOLS FOR THE LEVEL 1 AWARD!" may be provided to the player visually, or through suitable audio or audiovisual displays.

The central controller enables the active player to continue one or more plays of the game. In this example, each play of the bonus game includes one or more spins of the reels 54. To progress this example, the active player has accumulated three additional game events. Accordingly, the total game event meter 140 has incremented to four game events. In this example, if the active player accumulates one more bonus symbol, the total game event meter 140 will increment to five game events (which meets the threshold for the level 1 progressive award currently valued at $514,006.77).

Figure 6D:
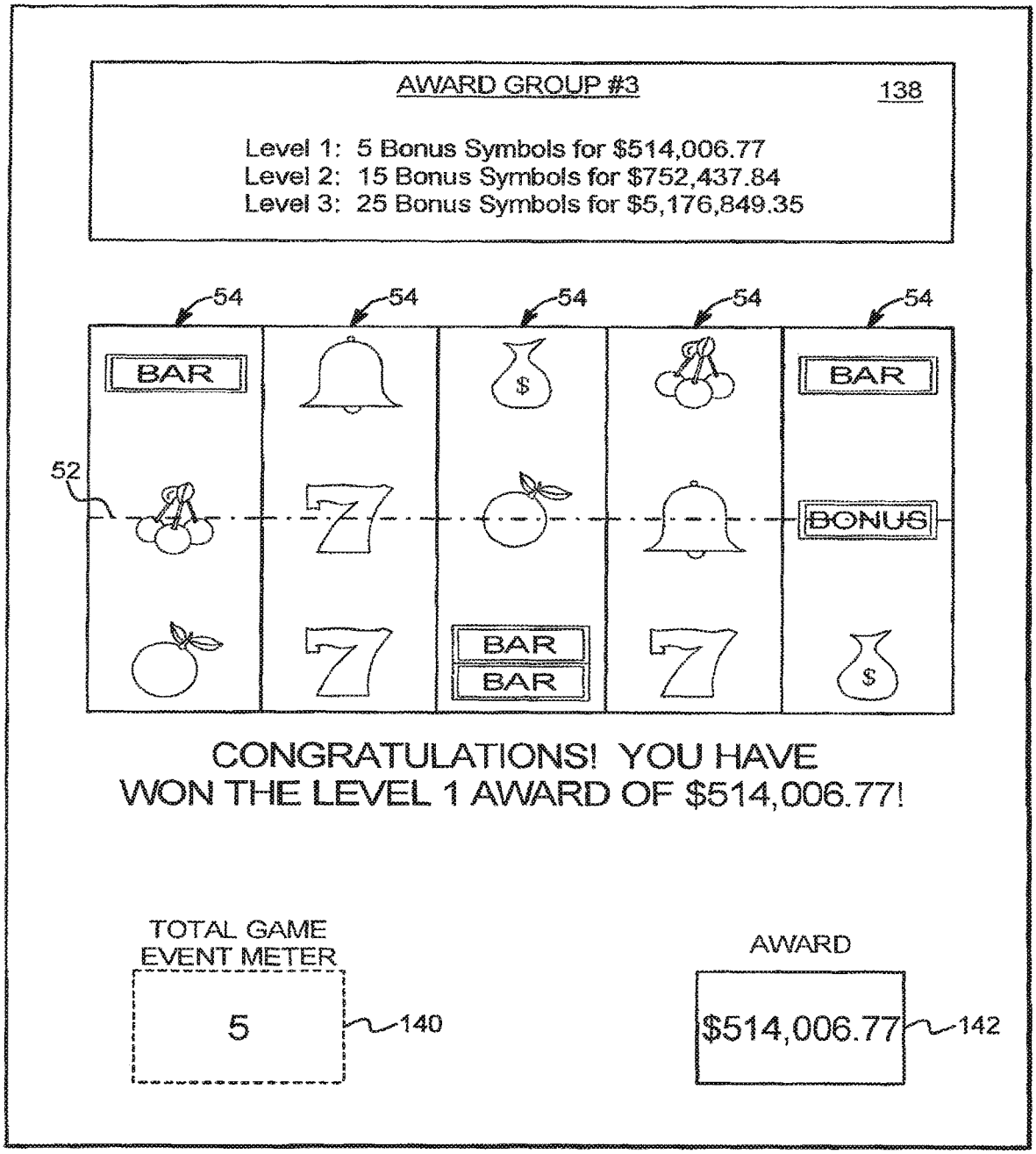

FIG. 6D continues this example with the gaming device having generated symbol combinations which included one bonus symbol on payline 52 associated with the reels 54. The total game event meter 140 increments by one and displays the total game events as five (which meets the threshold for the level 1 progressive award currently valued at $514,006.77). The award meter 142 displays an award of $514,006.77 since the player has accumulated enough bonus symbols to win the level one progressive award. Appropriate messages such as "CONGRATULATIONS! YOU HAVE WON THE LEVEL 1 PROGRESSIVE AWARD OF $514,006.77!" may be provided to the player visually, or through suitable audio or audiovisual displays.

In this example, the central controller controls the games played by the seven active players so that each player is provided with the same or different games having independent symbol generations. Whether the seven active players play the same game, or different games, is determined by the gaming system operator. In one embodiment, the active players play the same game associated with the same award group, wherein each game for each player is controlled independently by the central controller and/or the gaming device processor.

Figure 6E:
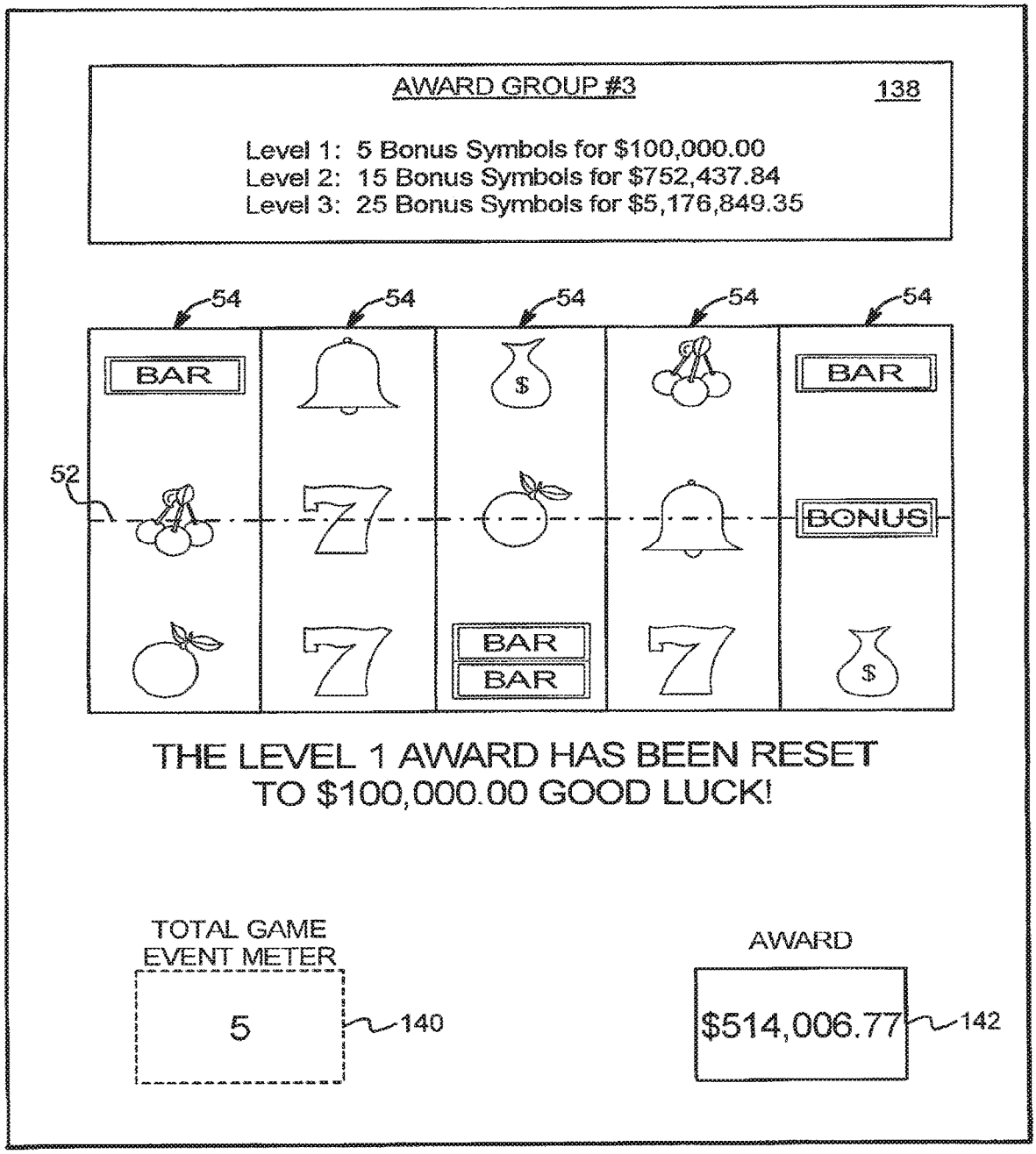

As seen in FIG. 6E, after providing the player the progressive award associated with the quantity of game events reaching the designated threshold, the central controller and/or gaming device processor resets the level one progressive award to its default value (e.g., $100,000) and starts incrementing from the default progressive award level.

In one embodiment, the central controller continues play of the bonus game for a designated number of reel activations, such as quantity of free spins. In this embodiment, the display device 16 or 18 can display the number of reel activations to the player. In this instance, the central controller maintains the total game event meter 140 and the award meter 142 at their respective levels until the designated number of reel activations are exhausted or played by the player. By providing a designated number of reel activations, the central controller enables the player to win one or more of the progressive awards without risking any awards won by the player during the reel activations.

In one embodiment, the central controller resets the total game event meter 140 to zero for the player who was provided the progressive award while keeping the total game event meters 140 for any other active players at the current value. By keeping the total game event meter 140 at the current level for the other active players, the central controller enables these other active players to win a progressive award despite one of the progressive awards being provided.

In one embodiment, the central controller enables the player to accept or reject the progressive award associated with the quantity of game events reaching the designated threshold. For example, the player can accept the progressive award valued at $514,006.77. In this example, if the player accepts the progressive award, the central controller resets the total game event meter 140 to zero to account for the provided progressive award. Alternatively, the player can reject the progressive award and continue playing the bonus game to accumulate more bonus symbols. In this example, if the player rejects the progressive award, the central controller maintains the total game event meter 140 at its current value (e.g., five). By continuing play, the player can attempt to win the second level progressive award valued at $752,437.84, or the third level progressive award valued at $5,176,849.35.

In one embodiment, the quantity of active players at the designated quantity of gaming devices determines the award available to the players during a game. As described above, the available award are associated with different tracked events which occur in association with the player's gaming experience. For example, as seen in the display area 138 of in FIG. 6B, a gaming device in the gaming system displays a first level progressive award of the third award group associated with an accumulation of a first designated quantity of total bonus symbols (e.g., five) and a second level progressive award of the third award group associated with an accumulation of a different quantity of total bonus symbols (e.g., fifteen).

In this embodiment, due to the different progressive awards based on different accumulations of gaming events, a plurality of progressive awards with different default values may overlap in value. Thus, even though one of the progressive awards associated with one of the tracked events is provided to a player, the remaining non-provided progressive awards associated with different tracked events continue to increment to greater and greater amounts until such progressive awards are provided to players. Thus, for every play of the primary and/or bonus game by the player, there are a number of award opportunities available and because of the cyclical nature of the progressives there is a high probability that one will be a desirable prize to play for, thus eliminating jackpot fatigue. In other words, in the gaming system disclosed herein, there is always the chance a player can receive one or more progressives for each primary and/or bonus game played. Accordingly, it is possible for the player to win a plurality of different types of progressive awards at once based on a single game play.

In another such embodiment, at least one of the progressive awards in the gaming system is associated with an amount of elapsed time. In this embodiment, the central server randomly selects a point in time from a predetermined time period. At the randomly selected point in time, the central server provides one of the progressive awards to an active player at a gaming device where a suitable gaming event occurs. In one such embodiment, the first gaming device where the suitable gaming event occurs is provided this progressive award. In this instance, the value of the progressive award is based on the quantity of active players at a designated number of the gaming devices in the gaming system.

In another embodiment, the gaming system is operable to group certain players together into different player groups. Accordingly, a quantity of active players is compared with a quantity of players in one of the player groups instead of a designated quantity of gaming devices, such as a bank of gaming devices. In one such embodiment, which player group a player is placed in or otherwise associated with is based on the player tracking status or ranking (obtained via a player tracking system) associated with that player. In another such embodiment, which player group a player is placed in or otherwise associated with is based on one or more aspects of the player's wagering history, such as the player's last wager or the player's average wager. In different embodiments, which player group a player is placed in or otherwise associated with is based on the type of games the player plays, randomly determined, predetermined, determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on the amount of coin-in accumulated in one or more pools, or determined based on any other suitable method or criteria. In one such embodiment, the central controller determines a quantity of all gold players registered in the player tracking system. After this determination, the central controller determines a quantity of the gold players who are actively playing at one of the gaming devices in the gaming system. In this instance, the central controller provides a bonus game associated with awards, which are based on the quantity of currently active gold players in the gaming system.

In these embodiments, each player group is associated with a separate award or award group. In one example, a first award or award group may be associated with 1 to 10 gold players, a second award or award group may be associated with 11 to 50 gold players, and a third award or award group may be associated with 51 to 100 gold players. In one such example, each award is associated with a separate threshold of events which must occur (and be tracked by the central server accordingly) to trigger a gaming device to provide that award to a player.

In one embodiment, the central controller enables zero, one or more players or gaming machines to be registered to a designated group. In one such embodiment, plays can voluntarily join or sign up for one or more designated groups. In one embodiment, each active player or each gaming machine includes a characteristic common to other players or gaming machines in the designated group, such as player status, minimum or maximum wager of the gaming machine, game type, or some other suitable factor. In another such embodiment, the central controller and/or the gaming device processor assigns or registers individual players or gaming devices to one or more groups either randomly or based on a suitable factor. In such embodiments, the quantity of active players in a designated group determines which award or awards will be available for the players associated with the designated group. For example, if the designated group includes five active players, the central controller associates a first award to the group and if the designated group includes seven active players, the central controller associates the first award and/or a second award to the group.

In one embodiment, the gaming system disclosed herein is associated with a designated promotion which includes a quantity of players actively participating (i.e., grouped) in the promotion. In one such promotion, a player remains active for the life of the promotion upon registration. In another such promotion, a player is required to perform certain tasks or complete designated objectives to remain active in the promotion. In this embodiment, the quantity of active players in the promotion affects which awards are available in the promotion. For example, if a promotion has 123 active players, a first award such as a watch, may be available to the active players of the promotion. If the promotion increases to 1000 or more active players, a second award such as a car may be available to the active players of the promotion.

In another embodiment, the designated promotion is structured so that each active player's chances of winning an award increases as the quantity of active players in the promotion increases. For example, when the designated promotion has a first quantity of active players (e.g., 1 to 100 players), each active player earns one entry for the promotion based on occurrences of tracked events in association with a game at the gaming machines. For example, players can earn one entry into a promotion after wagering $100 of coin-in or achieving a designated symbol or symbol combination in association with the game. When the designated promotion has a second quantity of active players (e.g., 101 to 500 players), each active player earns two entries for the promotion based on occurrences of tracked events in association with a game at the gaming machines. In this example, the number of entries for the same tracked event increases based on the number of active players in the promotion, which gives such players a greater chance to win an award.

In one embodiment, the gaming system and method disclosed herein includes a point or count based system to provide one or more awards to one or more players in an equitable manner, regardless of what game or game type they are playing. The points or counts used in this gaming system are accumulated by the gaming system for a player (such as in a player account) based on one or more events associated with the player's gaming experience. The points or counts utilized in the gaming system are selectively redeemable by the player in exchange for one or more awards or opportunities to win an award on any gaming device enrolled in the gaming system disclosed herein. It should be appreciated that in one embodiment, the points or counts disclosed herein are different, separate and independent from any monetary based points or credits, any promotional based points or credits, or any player tracking points. In other words, in this embodiment, the points or counts disclosed herein are not directly redeemable for direct currency and are further not associated with a player's point balance in a player's player tracking account.

In one embodiment, to account for the many different types of gaming devices in the gaming system providing different games with different parameters or characteristics, upon the occurrence of a point or count accumulation event, the gaming system utilizes one or more normalization equations to determine quantities of points or counts to provide to a player based on the player's specific wagering activity and the specific paytable associated with the player's currently played gaming device. In this embodiment, as the player may be playing at and thus utilizing any suitable paytable of any suitable gaming device in the gaming system, in determining an appropriate number of points or counts to provide to the player, the gaming system must account for, for example, the paytable of the specific game played by the player, including the average expected payout of each game played. In other words, in one embodiment, the gaming system disclosed herein equates or normalizes the earning or distribution of points or counts to provide equality to players playing different games at different gaming devices which are associated with different paytables.

In one embodiment, the gaming system enables a player to redeem any accumulated points or counts in the player's account to win one or more progressive awards. In this embodiment, if the player selects to cause a point or count redemption event to occur, the gaming system enables the player to selectively utilize their accumulated points or counts to determine what level and value of progressive award to provide to the player. In one such embodiment, to account for enabling the player to selectively be provided one or more of the different progressive awards associated with different suitable gaming devices of the gaming system, the gaming system determines the parameters of the available progressive awards based on the quantity of accumulated points or counts, the player's specific wagering activity and the specific paytable associated with the player's game. That is, since the player may select to play any suitable available game associated with the gaming system (and thus utilize the paytable of any suitable available game in the gaming system), in determining the quantity of points or counts which must be redeemed for each available game, the gaming system must account for the paytable of the specific game selected by the player, including the average expected payout of each game played. In other words, the gaming system disclosed herein enables a player to play any suitable available game incorporating any suitable available features when they want and the amount of points or counts which must be redeemed for a play of such a game is determined accordingly. Such a configuration provides that the different gaming machines associated with different paytables of the gaming system are integrated via the points or counts disclosed herein.

As seen in the example of FIGS. 6A to 6D, the awards or award pools include progressive awards. In one embodiment, a plurality of awards are available to players in a multi-level progressive (MLP) format. In one such embodiment, each level of the MLP is associated with a designated number of points earned by players upon the occurrence of a point or count accumulation event, such as by wagering a designated amount of coin-in or obtaining a designated symbol or symbol combination in a primary and/or secondary game. In different embodiments, players can earn points based on player status (as determined by a suitable player tracking system), enrolling in a designated promotion, paying a fee, entering a promotional code or pin number into one of the gaming devices, or any other suitable event in association with one of the gaming devices. In one embodiment, players can earn points based on an amount of time played at one of the gaming devices. For example, if a player plays one of the gaming devices at a designated time interval (e.g., between 2:30 pm and 3:30 pm), the player earns one point. In another example, if the player plays one of the gaming devices during a designated time period (e.g., 2:30 pm to 3:30 pm or 3:31 pm to 4:31 pm), the player earns one point.

The following table illustrates one example MLP format according to this embodiment wherein each level of the MLP is associated with a progressive award which accumulates from an initial value to a current value in addition to being associated with a point value or a range of point values.

| Award Level | Initial Award Value | Current Award Value | Points |
|---|---|---|---|
| 1 | $50 | $87 | 1 to 5,000 |
| 2 | $100 | $173 | 5,001 to 10,000 |
| 3 | $500 | $614 | 10,001 to 20,000 |
| 4 | $1,000 | $1,292 | 20,000 to 50,000 |
| 5 | $5,000 | $5,428 | 50,001 to 100,000 |

In this embodiment, the central controller selects a point value to serve as a triggering value for one of the progressive awards associated with the award levels. In different embodiments, the central controller randomly selects the point value, selects a predetermined point value, or selects the point value based on any suitable factor, such as time, a quantity of active players, or wager amount. If one of the players qualifies the selected point, the central controller causes the triggered progressive award to be provided to the player. For example, each player who (i) wagers a designated amount (e.g., max wager) in a play of the game, (ii) plays a designated number of games within a designated period of time, or (iii) achieves a number of designated events at the gaming machine earns one point. The central controller accumulates a total number of points earned by the players at the gaming machines. In this example, the central controller selects a point value associated with one of the progressive awards (i.e., one of the award levels in the MLP). When the accumulated number of points reaches the value selected by the central controller, the central controller provides (or causes one of the gaming machines to provide) the progressive award associated with the selected number of points to the player who earned the point which caused the total number of points to accumulate to the selected value.

In one example, the central controller selects 12,345 points as the triggering value for one of the progressive awards in the MLP. In the above table, the third level progressive award (e.g., currently valued at $614) is associated with a point range of 10,001 points to 20,0000 points. The selected value of 12,345 points falls within this range. In this example, the player who earns the 12,345$^{th}$ point is provided the third level progressive award (at its current or accumulated value). After providing the third level progressive award, the central controller resets the third level progressive award to its initial or starting value.

It should be appreciated that any non-provided progressive awards and the provided progressive award accumulate based on coin-in or some other suitable factor, such as side wagers. In one example, the central controller selects 12,345 coins as the triggering value for one of the progressive awards in the MLP. In this example, the triggering value is based on coin-in instead of points or counts. As compared with the above table, the third level progressive award (e.g., currently valued at $614) could be associated with a coin-in range of 10,001 coins to 20,0000 coins. The selected value of 12,345 points falls within this range. In this example, the player who earns the 12,345$^{th}$ point is provided the third level progressive award (at its current or accumulated value). After providing the third level progressive award, the central controller resets the third level progressive award to its initial or starting value.

In another example, the central controller selects a designated time as the triggering value for one of the progressive awards in the MLP. In this example, the central controller accumulates points earned by players at the gaming machines. The total number of points accumulated at the selected time (e.g., 2:45 pm on Tuesday) determines the level and size of the progressive award provided to one of the players. In this example, when the selected time occurs (e.g., 2:45 pm on Tuesday), the central controller determines the total number of accumulated points (e.g., 25,435 points). Based on the determined number of accumulated points, e.g., 25,435 points, the central controller determines to provide the fourth level progressive award currently valued at $1292 and associated with the point values 20,001 to 50,000 points. In another example, if the determined number of accumulated points is 300 points, the central controller determines to provide the first level progressive award currently valued at $87 and associated with the point values 1 to 5,000 points. In such examples, the central controller provides the fourth level and first level progressive awards to the players who earned the $25,435^{th}$ and $300^{th}$ points, respectively.

In one embodiment, a suitable algorithm is implemented to determine the player who earned the point at or closest to this time with tie-breaking based on any number of factors (e.g., player tracking history, amount of or recent wagers placed). In this embodiment, one of the progressive awards is provided to the player who the algorithm determined earned the point closest to the designated time when the progressive award is triggered. In another embodiment, one of the players who earned one or more points during a designated time period is randomly selected and the progressive award is provided to the selected player. In one embodiment, a suitable algorithm or a suitable physical meter is implemented to track the points earned by each individual player.

In another example, the central controller selects a designated quantity of active players as the triggering value for one of the progressive awards in the MLP. For example, the central controller tracks or maintains a count of each active player who is playing or has played in the gaming system during a designated period of time. In one embodiment, the total count or number of active players represents each player who has played for one of the progressive award since it was last reset. In other embodiments, the period of time can vary based on the award level of the MLP. For example, the central controller tracks or maintains a count of each active player who has played for one of the progressive awards since that progressive award was last reset. In this example, the central controller accumulates a total number of active players. If ten players are currently playing at the gaming machines, the tracked or accumulated count of active players would be ten active players. If three additional players are designated as active players, the total number of active players increases to thirteen. If one of the thirteen active players leaves the gaming system (i.e., cashes out or does not meet the requirements to be designated as an active player), the total number of active players remains at thirteen. That is, in this embodiment, although twelve players may be currently active at gaming devices in the gaming system, the central controller maintains the count at thirteen for providing one of the progressive awards.

In one example, the central controller associates a designated quantity of active players (or range of such quantities) as the triggering value for each of the progressive awards in the MLP. In this example, the fourth level progressive award is currently valued at $1292 and associated with 20,001 to 50,000 players. The central controller selects a designated player (e.g., $25,435^{th}$ player) as the triggering event for the fourth level progressive award. In this example, when the selected number of active players reaches the selected threshold or count (e.g., 25,435 players), the central controller determines to provide the fourth level progressive award currently valued at $1292 when the tracked or maintained count of each active player who has played for the fourth level progressive award (e.g., since that progressive award was last reset) reaches 25,435 active players. In one embodiment, each player is required to fulfill an obligation or requirement (e.g., wagering a designated amount, such as 100 monetary units or credits) to be designated as an active player.

In different embodiments, as described above, the award can be any suitable award type including non-progressive awards, progressive awards, modifiers, and increased payback percentages individually or in combination. For example, table 144 of FIG. 7A includes different quantities of active players wherein each quantity of active players (from a minimum number of players to a maximum number of players) is associated with an award group. A first award group includes a modifier and is associated with one to five players at a designated quantity of twenty gaming devices. A second award group includes different non-progressive or static awards and is associated with six to ten players at a designated quantity of twenty gaming devices. A third award group includes different non-progressive or static awards and is associated with eleven to fifteen players at a designated quantity of twenty gaming devices. A fourth award group includes a progressive award valued at $10,482,921.71 is associated with sixteen to twenty players at a designated quantity of twenty gaming devices.

Table 146 of FIG. 7B includes different quantities of active players wherein each quantity of active players (from a minimum number of players to a maximum number of players) is associated with an award group including different bonus events or bonus awards. In one embodiment, such bonus events include a generation of any outcome at one of the gaming devices, a generation of any outcome associated with an award over a designated value at one of the gaming devices, a generation of an outcome on a designated payline at one of the gaming devices, a generation of an outcome in a scatter configuration at one of the gaming devices, a generation of a designated symbol or symbol combination at one of the gaming devices, a generation of a designated symbol or symbol combination on a designated payline at one of the gaming devices, a generation of a designated symbol or symbol combination in a scatter configuration at one of the gaming devices, an award amount provided to any player, a triggering of a play of a secondary game at one of the gaming devices, an activation of a secondary display at one of the gaming devices, an activation of a community award generator, a generation of any outcome in a secondary game at one of the gaming devices, and an amount of free activations provided at one of the gaming devices. In another embodiment, the bonus awards include any suitable award type described above, such as non-progressive awards or progressive awards.

In one embodiment, the quantity of active players affects a number of picks or selections in a play of a secondary game at one of the gaming devices. For example, if a secondary game is triggered by a player, the player is provided with different quantities of picks or selections for the play of the secondary game based on the quantity of active players. If the quantity of active players is between 1 and 5, the player is provided a first quantity of picks or selections and if the quantity of active players is between 6 and 10, the player is provided a second, different quantity of picks or selections. The quantities or ranges of active players and the number of picks and selections can be set by the gaming system operator as desired to any suitable values.

In another embodiment, the quantity of active players affects a number of free spins in a play of a secondary game at one of the gaming devices. For example, if a secondary game is triggered by a player, the player is provided with different quantities of free spins for the play of the secondary game based on the quantity of active players. If the quantity of active players is between 1 and 20, the player is provided a first quantity of free spins and if the quantity of active players is greater than or equal to 21, the player is provided a second, different quantity of free spins. The quantities or ranges of active players and the number of free spins can be set by the gaming system operator as desired to any suitable values.

Table 148 of FIG. 7C includes different quantities of active players wherein each quantity of active players (from a minimum number of players to a maximum number of players) is associated with an award group including different average expected payback percentages. In one embodiment, the different average expected payback percentages are associated with a primary game played by the active players. In another embodiment, the different average expected payback percentages are associated with a bonus or secondary game played by the active players. In one such embodiment, each quantity of active players (e.g., six to ten players) is associated with an increase to the average expected payback percentage associated with a primary or secondary game. As illustrated in FIG. 7C, the increase associated with six to ten active players is 3%. Accordingly, the central controller increases the average expected payback percentage associated with a primary or secondary game for the active players. Alternatively, the central controller increases the average expected payback percentage to a designated value (e.g., from 90% to 93%) based on the quantity of active players. As seen in FIG. 7C, the fourth award group is associated with sixteen to twenty players and increases the average expected payback percentage associated with a primary or secondary game to at least 100% for the active players.

It should be appreciated that the average expected payback percentage can be increased in any suitable method. In one such embodiment, the gaming system changes the average expected payback percentage (or the average expected hold percentage) of the gaming machine being played by the player. To change the average expected payback percentage (or the average expected hold percentage), the gaming system changes the game being played by the player or at least one aspect associated with the game. In different embodiments, such aspects include at least one displayed paytable associated with the game being played by the player, at least one mapping of a paytable associated with the game being played by the player, at least one award sequence associated with the game, an eligibility to play the game, or any combination thereof. It should also be appreciated that such aspects include, but are not limited to, the following:

(1) at least one additional chance in either the primary game or the bonus game associated with the gaming machine, such as free spins in a reel game, additional selections in a selection game, or free cards or draws in a poker game;

(2) at least one additional chance to win an award, such as a mystery award, which may or may not be associated with, or dependent on, either the primary game or the bonus game associated with the gaming machine;

(3) an increased frequency of awards for either the primary game or the bonus game associated with the gaming machine;

(4) an increased size of awards for either the primary game or the bonus game associated with the gaming machine;

(5) at least one advantage or additional feature in either the primary game or bonus game associated with the gaming machine, such as providing an additional pick or a hint in a selection game, or by reducing a threshold for a player to qualify for a certain game round or game award (i.e., the top level progressive award in a multi-level progressive game);

(6) at least one additional symbol or symbol combination (e.g., physical or virtual) in either the primary game or the bonus game associated with the gaming machine;

(7) at least one additional winning outcome for either the primary game or the bonus game associated with the gaming machine;

(8) at least one changed pay value associated with at least one of the symbols or symbol combinations in either the primary game or the bonus game associated with the gaming machine;

(9) a different or modified primary game or bonus game associated with the gaming machine, wherein such different primary game includes a different theme, different symbols, a different volatility, or a different paytable as the original primary game;

(10) a display caused by a controller or server, wherein such display by a service window associated with the server causes a notification to the player of a changed payback percentage (or hold percentage) associated with either the primary game or the bonus game associated with the gaming machine;

(11) at least one symbol overlay, such as a double symbol or a changed symbol for either the primary game or the bonus game associated with the gaming machine;

(12) enabling one or more progressive awards associated with either the primary game or the bonus game associated with the gaming machine; and

(13) an increment rate of one or more progressive awards associated with either the primary game or the bonus game associated with the gaming machine.

As described above, the awards associated with each quantity of active players, or the awards of different award pools associated with each quantity of active players can be any one or a combination of predetermined awards, randomly determined awards, fixed or non-progressive awards, progressive awards, awards determined based on the player's status (such as determined through a player tracking system), awards determined based on a generated symbol or symbol combination, awards determined based on a random determination by the central controller, awards determined based on a random determination at the gaming machine, awards determined based on one or more side wagers placed, awards determined based on time (such as the time of day), awards determined based on an amount of coin-in accumulated in one or more pools or awards determined based on any other suitable method or criteria. In different embodiments, such awards may include, but are not limited to, a value, one or more multipliers, one or more modifiers, one or more anti-terminators, one or more offers to accept or reject, one or more plays of one or more games utilizing an enhanced paytable, one or more additional player picks in a selection game, one or more activations of an award generator, one or more retriggers, one or more nudges, a number of free games, or a replay of one or more previous games.

In one embodiment, the at least one controller is programmed or configured to operate with a plurality of gaming devices to maintain a plurality of progressive awards. At a first point in time, the controller is programmed to determine a quantity of the gaming devices which are being actively played. The controller is programmed to cause a display of an indication of a first number of the maintained progressive awards which can each be provided at each of the actively played gaming devices if the determined quantity of actively played gaming devices is less than a first quantity. The controller is programmed to cause a display of an indication of a second number of the maintained progressive awards which can each be provided at each of the actively played gaming devices if the determined quantity of actively played gaming devices is at least the first quantity. For each of the maintained progressive awards associated with the indicated number, if an award condition associated with the progressive award occurs in association with one of the actively played gaming devices, the controller is programmed to cause the actively played gaming device to provide the progressive award. In one embodiment, the controller is programmed to cause a display of a progressive award amount for each of the maintained progressive awards associated with the indicated number of progressive awards.

In one embodiment, the first quantity of actively played gaming devices is a designated quantity, such as one, two, or three. In one embodiment, the first number of the progressive awards which can each be provided at each of the actively played gaming devices is based on the determined quantity. In one embodiment, the second number is based on the determined quantity and is different than the first number. In one embodiment, the second quantity is at least equal to the first quantity.

In one embodiment, the controller is programmed to operate with a plurality of gaming devices to maintain a plurality of different awards. At a first point in time, the controller is programmed to determine a quantity of the gaming devices which are in an active state. The controller is programmed to cause a display of an indication of a first number of the maintained awards which can each be provided at each of the gaming devices in the active state if the determined quantity of active gaming devices is less than a first quantity. The controller is programmed to cause a display of an indication of a second number of the maintained awards which can each be provided at each of the gaming devices in the active state if the determined quantity of gaming devices in the active state is at least equal to a second quantity. For each of the maintained awards associated with the indicated number of awards, if an award condition associated with the award occurs in association with one of the actively played gaming devices, the controller is programmed to cause the actively played gaming device to provide the award. In one embodiment, the controller is programmed to cause a display of an award amount for each of the awards associated with the indicated number of awards.

In one embodiment, the first quantity is at least two. In one embodiment, the first number of the awards which can each be provided at each of the actively played gaming devices is based on the determined quantity. In one embodiment, the second number is based on the determined quantity and is different than the first number. In one embodiment, the second quantity is at least equal to the first quantity.

In one embodiment, the controller is programmed or configured to operate with a plurality of gaming devices to maintain a plurality of progressive awards. At a first point in time, the controller is programmed to determine a quantity of the gaming devices which are being actively played. The controller is programmed to operate with a plurality of gaming devices to cause a display of an indication of a first number of the maintained progressive awards which can each be provided at each of the actively played gaming devices if the determined quantity of actively played gaming devices is one of a first plurality of different quantities. The controller is programmed to cause a display of an indication of a second number of the maintained progressive awards which can each be provided at each of the actively played gaming devices. For each of the maintained progressive awards associated with the indicated number of progressive awards, if an award condition associated with said progressive award occurs in association with one of the actively played gaming devices, the controller is programmed to cause the actively played gaming device to provide the progressive award. In one embodiment, the controller is programmed to cause a display of a progressive award amount for each of the number of indicated progressive awards.

In one embodiment, the first number is based on the first plurality of different quantities. In one embodiment, the second number is different than the first number. In one embodiment, the first plurality of quantities is different than the second plurality of quantities.

In one embodiment, the controller is programmed to operate with a plurality of gaming devices configured such that, at different points in time, different designated quantities of the plurality of gaming devices can be actively played. The controller is programmed to maintain a plurality of progressive awards such that different numbers of the progressive awards are associated with different designated quantities of the actively played gaming devices.

At a first point in time, the controller is programmed to determine which of the different designated quantities of the gaming devices are currently being actively played. For the determined quantity of actively played gaming devices, the controller is programmed to cause a display of an indication of the number of the maintained progressive awards which can be provided at the determined designated quantity of the actively played gaming devices. For each of the maintained progressive awards associated with the indicated number of progressive awards, if an award condition associated with the progressive award occurs in association with one of the actively played gaming devices, the controller is programmed to cause the actively played gaming device to provide the progressive award.

In one embodiment, the controller is programmed to operate with a plurality of gaming devices to maintain a plurality of different awards. For one or more of the gaming devices being actively played at a first point in time, the controller is programmed to determine a number of the maintained progressive awards which can be provided at the actively played gaming device. In one embodiment, the number of the progressive awards which can be provided at the actively played gaming device is based on whether at least another one of the gaming devices is being actively played at the first point in time. The controller is programmed to cause an indication of the determined number of the progressive awards which can be provided at the actively played gaming device. For each of the maintained progressive awards associated with the indicated number of progressive awards, if an award condition associated with the progressive award occurs in association with one of the actively played gaming devices, the controller is programmed to cause the actively played gaming device to provide the progressive award. In one embodiment, the number of the progressive awards which can be provided at a first one of the actively played gaming device increases when the number of other gaming devices being actively played increases.

Display of Information to Players

As indicated above, the awards and/or the bonus game may be provided to the players of the gaming machines with or without explanation or information provided to the player, or alternatively information can be displayed to the player. In one embodiment, suitable information about the awards and/or the bonus game can be provided to the players through one or more displays on the gaming machines or additional information displays positioned near the gaming machines, such as above a bank of system gaming machines.

In one embodiment, the gaming system enables the central server to communicate with one or more sign controllers. The central controller instructs the sign controller as to what content to display, where to display such content, how to display such content and for how long to display such content. In one embodiment, the sign controller displays any information relating to available awards, such as progressive awards, associated with one or more quantities of active players. For example, the sign controller causes the sign to display the current values of each progressive award the gaming machine (or bank of gaming machines) is currently connected to or associated with (based on the quantity of active players). In another embodiment, the sign controller causes one or more signs to display information such as winners and jackpots won.

In one embodiment, the control of the signage helps to communicate information relating to one or more awards available to the players and keeps player excitement up. In different embodiments, the signs are used to show the current award levels as well as jackpot or progressive award hits and any progressive awards won by those who achieved the hits. In one embodiment, the central controller communicates the status of any multi-level progressive awards with the sign controllers for display of information relating to such awards.

Such signage or information can be used to entertain the player or inform the player that a triggering event for a progressive award and/or the bonus game has occurred or will occur. Examples of such information are:

(1) that a progressive award triggering event has occurred;

(2) that a progressive award triggering event will shortly occur (i.e., foreshadowing the providing of a progressive award);

(3) that one or more progressive awards have been provided to one or more players of the system gaming machines;

(4) which gaming machines have won the progressive awards;

(5) the amount of the progressive awards won;

(6) the highest progressive award won;

(7) the lowest progressive award won;

(8) the average progressive award won;

(9) number of games played/total time since the last progressive award was won;

(10) the average time between progressives being hit;

(11) the number of progressive awards won in a designated time period;

(12) the amount of the progressive awards that can be won;

(13) the active status associated with the progressive awards for each individual player; and

(14) the active time associated with the progressive awards for each individual player.

It should be appreciated that such information can be provided to the players through any suitable audio, audio-visual or visual devices.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming system comprising:

at least one display device;

an acceptor;

at least one processor; and at least one memory device which stores a plurality of instructions, which when executed by the at least one processor, cause the at least one processor to:

determine a ranking of a player, assign, based at least in part on the determined ranking, the player to a player group, responsive to the player being assigned to a first player group of at least two players:

associate a first group of at least one award with the player, wherein:

the first player group is associated with the first group of at least one award, separate from any determination to provide any award of the first group of at least one award to any player, a first award of the first group of at least one award has a first value when the first player group comprises a first quantity of at least two players, separate from any determination to provide any award of the first group of at least one award to any player, the first award of the first group of at least one award has a second, different value when the first player group comprises a second, different quantity of at least two players, each award of the first group of at least one award is available to be provided to the player during each of and as part of a plurality of plays of a game by that player while that player is assigned to the first player group, and at least one of the plurality of plays of the game by that player occurs following a modification of a credit balance responsive to receipt, via the acceptor, of a physical item associated with a monetary value, and for the plurality of plays of the game, cause the at least one display device to display an indication of the first group of at least one award, and responsive to the player being assigned to a second, different player group of at least two players:

associate a second, different group of at least one award with the player, wherein:

the second, different player group is associated with the second, different group of at least one award, each award of the second group of at least one award is available to be provided to the player during each of and as part of the plurality of plays of the game by that player while that player is assigned to the second, different player group, and the at least one of the plurality of plays of the game by that player occurs following the modification of the credit balance responsive to receipt, via the acceptor, of the physical item associated with the monetary value, and for the plurality of plays of the game, cause the at least one display device to a display an indication of the second, different group of at least one award.

2. The gaming system of claim 1, wherein when executed by the at least one processor, the plurality of instructions cause the at least one processor to determine the ranking of the player based on a player tracking status of the player and at least one activity of the player compared to at least one activity of at least one other player associated with the same player tracking status.

3. The gaming system of claim 1, wherein when executed by the at least one processor, the plurality of instructions cause the at least one processor to determine the ranking of the player based on if the player is an active player.

4. The gaming system of claim 1, wherein when executed by the at least one processor, the plurality of instructions cause the at least one processor to determine the ranking of the player based on at least one activity of the player during a designated period of time.

5. The gaming system of claim 1, wherein at least one of the awards of at least one of the groups of awards is selected from the group consisting of: a progressive award, a quantity of monetary credits, a quantity of non-monetary credits, a quantity of promotional credits, and a quantity of player tracking points.

6. The gaming system of claim 1, wherein a first award of the second, different group of at least one award has a third value when the second, different player group comprises the first quantity of at least two players, and the first award of the second, different group of at least one award has a fourth value when the second, different player group comprises the second, different quantity of at least two players, the fourth value being different from the third value.

7. A gaming system server comprising:

at least one processor; and at least one memory device which stores a plurality of instructions, which when executed by the at least one processor, cause the at least one processor to:

determine a ranking of a player, assign, based at least in part on the determined ranking, the player to a player group, responsive to the player being assigned to a first player group of at least two players:

associate a first group of at least one award with the player, wherein:

the first player group is associated with the first group of at least one award, separate from any determination to provide any award of the first group of at least one award to any player, a first award of the first group of at least one award has a first value when the first player group comprises a first quantity of at least two players, separate from any determination to provide any award of the first group of at least one award to any player, the first award of the first group of at least one award has a second, different value when the first player group comprises a second, different quantity of at least two players, each award of the first group of at least one award is available to be provided to the player during each of and as part of a plurality of plays of a game by that player while that player is assigned to the first player group, and at least one of the plurality of plays of the game by that player occurs following a modification of a credit balance responsive to receipt, via an acceptor, of a physical item associated with a monetary value, and for the plurality of plays of the game, cause at least one display device to display an indication of the first group of at least one award, and responsive to the player being assigned to a second, different player group of at least two players:

associate a second, different group of at least one award with the player, wherein:

the second, different player group is associated with the second, different group of at least one award, each award of the second group of at least one award is available to be provided to the player during each of and as part of the plurality of plays of the game by that player while that player is assigned to the second, different player group, and the at least one of the plurality of plays of the game by that player occurs following the modification of the credit balance responsive to receipt, via the acceptor, of the physical item associated with the monetary value, and for the plurality of plays of the game, cause the at least one display device to display an indication of the second, different group of at least one award.

8. The gaming system server of claim 7, wherein when executed by the at least one processor, the plurality of instructions cause the at least one processor to determine the ranking of the player based on a player tracking status of the player and at least one activity of the player compared to at least one activity of at least one other player associated with the same player tracking status.

9. The gaming system server of claim 7, wherein when executed by the at least one processor, the plurality of instructions cause the at least one processor to determine the ranking of the player based on if the player is an active player.

10. The gaming system server of claim 7, wherein when executed by the at least one processor, the plurality of instructions cause the at least one processor to determine the ranking of the player based on at least one activity of the player during a designated period of time.

11. The gaming system server of claim 7, wherein at least one of the awards of at least one of the groups of awards is selected from the group consisting of: a progressive award, a quantity of monetary credits, a quantity of non-monetary credits, a quantity of promotional credits, and a quantity of player tracking points.

12. The gaming system server of claim 7, wherein a first award of the second, different group of at least one award has a third value when the second, different player group comprises the first quantity of at least two players, and the first award of the second, different group of at least one award has a fourth value when the second, different player group comprises the second, different quantity of at least two players, the fourth value being different from the third value.

13. A method of operating a gaming system, said method comprising:

determining, by at least one processor, a ranking of a player, assigning, by the at least one processor and based at least in part on the determined ranking, the player to a player group, responsive to the player being assigned to a first player group of at least two players:

associating, by the at least one processor, a first group of at least one award with the player, wherein:

the first player group is associated with the first group of at least one award, separate from any determination to provide any award of the first group of at least one award to any player, a first award of the first group of at least one award has a first value when the first player group comprises a first quantity of at least two players, separate from any determination to provide any award of the first group of at least one award to any player, the first award of the first group of at least one award has a second, different value when the first player group comprises a second, different quantity of at least two players, each award of the first group of at least one award is available to be provided to the player during each of and as part of a plurality of plays of a game by that player while that player is assigned to the first player group, and at least one of the plurality of plays of the game by that player occurs following a modification of a credit balance responsive to receipt, via an acceptor, of a physical item associated with a monetary value, and displaying, by at least one display device and for the plurality of plays of the game, an indication of the first group of at least one award, and responsive to the player being assigned to a second, different player group of at least two players:

associating, by the at least one processor, a second, different group of at least one award with the player, wherein:

the second, different player group is associated with the second, different group of at least one award, each award of the second group of at least one award is available to be provided to the player during each of and as part of the plurality of plays of the game by that player while that player is assigned to the second, different player group, and the at least one of the plurality of plays of the game by that player occurs following the modification of the credit balance responsive to receipt, via the acceptor, of the physical item associated with the monetary value, and displaying, by the at least one display device and for the plurality of plays of the game, an indication of the second, different group of at least one award.

14. The method of claim 13, further comprising determining, by the at least one processor, the ranking of the player based on a player tracking status of the player and at least one activity of the player compared to at least one activity of at least one other player associated with the same player tracking status.

15. The method of claim 13, further comprising determining, by the at least one processor, the ranking of the player based on if the player is an active player.

16. The method of claim 13, further comprising determining, by the at least one processor, the ranking of the player based on at least one activity of the player during a designated period of time.

17. The method of claim 13, wherein at least one of the awards of at least one of the groups of awards is selected from the group consisting of: a progressive award, a quantity of monetary credits, a quantity of non-monetary credits, a quantity of promotional credits, and a quantity of player tracking points.

18. The method of claim 13, which is executed through a data network.

19. The method of claim 18, wherein the data network is an internet.

20. The method of claim 13, wherein a first award of the second, different group of at least one award has a third value when the second, different player group comprises the first quantity of at least two players, and the first award of the second, different group of at least one award has a fourth value when the second, different player group comprises the second, different quantity of at least two players, the fourth value being different from the third value.

* * * * *